US005958512A

United States Patent [19]

Krish et al.

[11] Patent Number: 5,958,512

[45] Date of Patent: Sep. 28, 1999

[54] METHOD AND APPARATUS FOR SELECTIVELY REMOVING OR DISPLACING A FLUID ON A WEB

[75] Inventors: Prem Krish, Aurora; John E. Johansen, Ashtabula; R. Matthew Giachetto, Concord; Kyung W. Min, Mentor; Lawrence J. Schnieders, Eastlake; Yefim Slobodkin, Lyndhurst, all of Ohio

[73] Assignee: Avery Dennison Corporation, Pasadena, Calif.

[21] Appl. No.: 08/769,772

[22] Filed: Dec. 19, 1996

[51] Int. Cl.[6] ..... B05D 3/04

[52] U.S. Cl. ..... 427/338; 427/348; 427/349

[58] Field of Search ..... 118/63, 62; 427/240, 427/338, 348, 349

[56] References Cited

U.S. PATENT DOCUMENTS

| | | | |
|---|---|---|---|
| 2,894,856 | 7/1959 | Schwendemann et al. | 117/114 |
| 3,272,176 | 9/1966 | Saydlowski | 118/63 |
| 3,445,270 | 5/1969 | Lorck | 117/102 |
| 3,871,326 | 3/1975 | Kanda et al. | 118/63 |
| 3,881,040 | 4/1975 | Patterson | 427/349 |
| 3,977,359 | 8/1976 | Botarro | 118/63 |
| 4,137,347 | 1/1979 | Graff et al. | 427/349 |
| 4,147,781 | 4/1979 | Narukawa et al. | 523/222 |
| 4,157,903 | 6/1979 | Kanda et al. | 55/393 |
| 4,237,815 | 12/1980 | Ernest | 118/63 |
| 4,246,301 | 1/1981 | Alheid et al. | 427/428 |
| 4,259,006 | 3/1981 | Phillips et al. | 355/10 |
| 4,321,884 | 3/1982 | Barkley | 118/63 |
| 4,346,129 | 8/1982 | Decker et al. | 427/348 |
| 4,364,327 | 12/1982 | Barrett | 118/102 |
| 4,386,998 | 6/1983 | McIntyre et al. | 156/473 |
| 4,416,919 | 11/1983 | Beck | 427/296 |
| 4,417,540 | 11/1983 | Wohlfeil | 118/63 |
| 4,749,432 | 6/1988 | Ando et al. | 156/257 |
| 4,887,545 | 12/1989 | Soininen | 118/63 |
| 4,996,091 | 2/1991 | McIntyre | 428/113 |
| 5,009,016 | 4/1991 | LePisto et al. | 34/421 |
| 5,074,242 | 12/1991 | Bricmont | 118/665 |
| 5,221,345 | 6/1993 | Blankenship et al. | 118/63 |
| 5,254,166 | 10/1993 | Tu | 118/63 |
| 5,332,437 | 7/1994 | Davene et al. | 118/63 |
| 5,346,551 | 9/1994 | Pannenbecker et al. | 118/63 |
| 5,368,893 | 11/1994 | Sommer et al. | 427/348 |
| 5,399,403 | 3/1995 | Instance | 428/40 |
| 5,505,995 | 4/1996 | Leonard | 427/348 |
| 5,755,881 | 5/1998 | Fenoglio et al. | 118/50 |

*Primary Examiner*—José G. Dees
*Assistant Examiner*—Alton Pryor
*Attorney, Agent, or Firm*—Renner, Otto, Boisselle & Sklar, P.L.L.

[57] ABSTRACT

An apparatus for forming bands of reduced coat weight of a coating on a coated web that is moving through a laminating machine includes a supply of fluid and a nozzle for directing a stream of fluid from the supply toward the web, said nozzle having a relatively small outlet aperture for directing a relatively narrow width stream of fluid toward the web compared to the width of the web to impinge on the web to reduce the coat weight over a relatively narrow width band. The bands may be formed in the machine direction of travel of the web, across the width of the web in a direction other than the machine direction and may be of various width and may be precisely or randomly placed. The reduced coat weight areas may be narrow bands or broader areas of the web. A method for forming a band of reduced coat weight of a coating on a coated web includes directing a stream of fluid toward the web and extending over a relatively narrow width of the web compared to the width of the web to impinge on the web to reduce the coat weight over a relatively narrow width band or over a relatively broader area of the web.

57 Claims, 19 Drawing Sheets

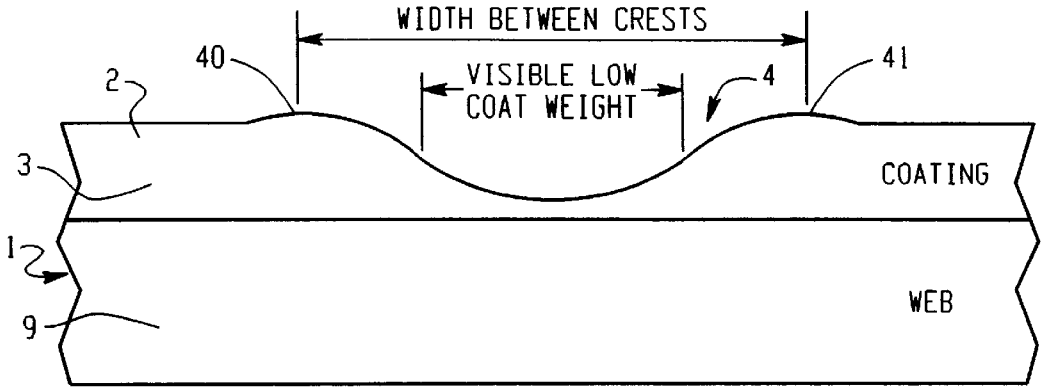

Fig. 7

| RUN # | p.(psi) | θ.(deg) | Φ.(in) | δ.(in) | Q.(cfm) | v.(fmp) | $w_c$.(in) | $w_{vb}$.(in) |
|---|---|---|---|---|---|---|---|---|
| 1 | 6.0 | 25 | 0.063 | 0.500 | 1.0 | 32,900 | 0.375 | 0.125 |
| 2 | 10.0 | 25 | 0.063 | 0.125 | 1.5 | 42,200 | 0.500 | 0.250 |
| 3 | 10.0 | 25 | 0.125 | 0.125 | 5.0 | 35,200 | 0.938 | 0.500 |
| 4 | 10.0 | 25 | 0.188 | 0.500 | 8.9 | 27,600 | 1.313 | 0.563 |
| 5 | 10.0 | 25 | 0.188 | 0.125 | 8.9 | 27,600 | 1.250 | 0.563 |
| 6 | 10.0 | 0 | 0.125 | 0.500 | 5.5 | 38,100 | 1.063 | 0.438 |
| 7 | 6.0 | 0 | 0.188 | 0.250 | 5.1 | 18,800 | 1.250 | 0.563 |
| 8 | 10.0 | -25 | 0.003 | 0.125 | 0.5 | 56,300 | 0.250 | 0.125 |
| 9 | 6.0 | -25 | 0.063 | 0.125 | 1.0 | 30,500 | 0.375 | 0.250 |
| 10 | 10.0 | -25 | 0.063 | 0.500 | 1.3 | 37,500 | 0.500 | 0.250 |
| 11 | 10.0 | -25 | 0.125 | 0.125 | 5.1 | 35,800 | 1.000 | 0.500 |
| 12 | 10.0 | -25 | 0.188 | 0.500 | 8.9 | 27,600 | 1.500 | 0.688 |

p = STATIC PRESSURE AT THE NOZZLE IN psig
θ = NOZZLE ANGLE FROM WEB NORMAL IN DEGREES
Φ = NOZZLE DIAMETER IN INCHES
δ = NOZZLE TO WEB DISTANCE IN INCHES
Q = VOLUMETRIC AIR FLOW RATE IN cfm AT STP
v = DISCHARGE VELOCITY AT THE NOZZLE IN ft/min
$w_c$ = WIDTH BETWEEN BAND CRESTS IN INCHES
$w_{vb}$ = WIDTH OF VISIBLE BAND IN INCHES (<11gsm)

Fig. 8A $x_g$ = NOZZLE GAP WIDTH (in)

$v_f$ = VELOCITY OF FLUID AT NOZZLE (fpm)

d = DISTANCE: NOZZLE TO WEB (in)

$x_a$ = APERTURE WIDTH (in)

METHOD AND APPARATUS FOR SELECTIVELY REMOVING OR DISPLACING A FLUID ON A WEB

TECHNICAL FIELD

The present invention relates generally to an apparatus and method for making fluid coated web materials, such as adhesive coated web materials, and to web materials made thereby, and, more particularly, the invention relates to the formation of reduced coat weight areas in and/or for removing coating from a coated web in the web travel direction (sometimes referred to as the machine direction) and/or in a cross, diagonal or other direction.

BACKGROUND

Various types of adhesive coated materials are known. An example of an adhesive coated material is that typically used for a label or decal. The adhesive coating on the label or decal may be, for example, a hot melt, an emulsion, or a silicone material. The adhesive material may be used to effect adherence of the label or decal in response to application of pressure between the label or decal and an object onto which it is to be adhered.

Sheet material, such as sheets of paper or plastic-like material supporting adhesive coated labels sometimes are fed through laser printers and/or other printing devices. The laser printer, for example, usually grabs the sheet material and pulls it through the printer as information is printed on the labels. Sometimes the adhesive material on the sheet material will get on the rollers of the printer and will cause damage to the rollers and/or to other equipment of the printer. Another problem is jamming of the printer, especially of a laser printer, which causes a loss of material and lost production and operator time. For example, usually the leading edge of the sheet material is grabbed by pinch rollers and is pulled through the printer; and the pinch effect can cause the adhesive material to ooze from between the support sheet and label sheet of the sheet material and damage the pinch rollers and/or other parts of the printer. This effect is accentuated by the application of heat in the laser printer. Similar effect can occur at other parts of the sheet material and especially at edges thereof. Such label sheet material or label stock is manufactured as relatively narrow or wide webs, and in the latter or both cases the manufactured material may be subsequently cut to form sheets, say of 8 ½ inches by 11 inches in size, A4 size, or some other size. For example, a roll of web material may have a width that is several times the width of the intended finished sheets, and the web may be cut down across the width thereof into several sheets. Adhesive material at the edges of the finished cut sheets may cause the aforementioned printer damage. The aforesaid problems also may occur in other printers, non-limiting examples being ink jet printers, pin printers, bubble printers, etc.

It would be desirable to avoid the aforementioned damage to such printer equipment and the like.

A technique to smooth a coating for uniformity across the surface of a moving web has used air flow from an air knife. The air knife has a nozzle that extends across the width of the web and blows a wide stream of air against the web to smooth the coating. Various techniques have been used to avoid nonuniformity in flow across the width of the web and to remove and/or to capture excess coating material which may drop from the web or become entrained in the flow from the air knife.

Also, techniques have been used mechanically to scrape against the surface of a web to remove adhesive material from the web as the web is moved past and against the scraper blade.

Various mechanical devices have been used to remove adhesive material from a moving web, and those have required substantial coarse and fine adjustments which require substantial time and reduce production.

The prior techniques for removing adhesive material from a moving web to effect a smoothing action (or in a smoothing fashion) have been able only to remove material along a path in the machine direction (also referred to as the direction of web travel during manufacturing of the web). However, such techniques have not been able to selectively reduce adhesive coat weight in the cross direction or transverse direction relative to the machine direction.

SUMMARY

According to one aspect of the invention air impingement is used to form bands of reduced coat weight (of a coating, for example, adhesive or some other material) on a moving web material.

According to another aspect, the bands can be formed in the machine direction by directing one or more relatively small cross sectional area fluid streams against the web to move coating material away from the area of impingement.

According to another aspect, bands of reduced coat weight may be formed in the cross direction, i.e., across the width, of the web material as it is moving in the machine direction.

According to another aspect, bands of reduced coat weight may be formed in the diagonal direction.

According to another aspect, bands of reduced coat weight may be formed in virtually any direction, including randomly, during manufacturing of the coated web.

According to another aspect, the cross direction bands of reduced coat weight are formed by periodically directing a fluid stream against the web at selected locations along the web.

According to another aspect, the fluid stream(s) for forming the bands of low coat weight may be controlled in pressure, flow velocity, positioning or geometry, and/or on/off thereby correspondingly to control the character of the band(s) formed and whether a band is formed at all.

According to another aspect areas of increased coat weight are formed on a coated web by directing fluid streams against the web to move coating material thereon such that the moved material effects constructive interference with other moved coating material thereby increasing the coat weight at the areas of such constructive interference.

Another aspect of the invention is to provide in two (or more) directions bands of relatively low adhesive coat weight on a web coated with an adhesive material.

Another aspect is to obtain a predetermined nonuniform coat weight distribution on a moving web.

Another aspect relates to the patterning of a coating on a web to reduce the quantity of coating required to achieve a desired result, such as adhesion, for example, thereby saving coating material.

Another aspect is to facilitate setting up and/or adjusting a machine for making adhesive coated web material with selected areas of relatively low adhesive coat weight.

Another aspect is to provide areas of relatively high and relatively low adhesion on adhesive coated material.

Another aspect relates to apparatus for forming bands of reduced coat weight of a coating on a coated web, including a supply of fluid, a nozzle for directing a stream of fluid from the supply toward the web, the nozzle having a relatively small outlet aperture for directing a relatively narrow width stream of fluid toward the web compared to the width of the web to impinge on the web to reduce the coat weight over a relatively narrow width band.

Another aspect relates to a method for forming a band of reduced coat weight of a coating on a coated web, including directing toward the web a stream of fluid, which extends over a relatively narrow width of the web compared to the width of the web, to impinge on the web to reduce the coat weight over a relatively narrow width band.

Another aspect relates to a method for forming a low adhesive coat weight band on a coated web moving in a direction, including selectively directing against respective areas of the web a fluid stream across at least a substantial portion of the width of the web generally in a cross direction relative to the web moving direction to thin the coating on the area of impingement.

Another aspect relates to a method of forming a non-uniform adhesive coat weight of adhesive material on a moving web, including directing a flow of fluid toward only selected areas of the web to move adhesive coat material from the area of impingement.

Another aspect relates to a method of forming an area of a reduced adhesive coat weight of an adhesive coating on a web, including directing a flow of fluid toward the web to move coating material away from the area of impingement of the fluid, and allowing the formation of an increased viscosity of the coating material adjacent the reduced coat weight area to restrain the coating material from reflowing into the reduced coat weight area.

Another aspect relates to a method of forming an area of a reduced adhesive coat weight of an adhesive coating on a web, including directing a flow of fluid toward the web to move coating material away from the area of impingement of the fluid, and allowing the formation of a skin of the coating material adjacent the reduced coat weight area to restrain the coating material from reflowing into the reduced coating weight area.

Another aspect relates to a method of forming selectively increased adhesive coat weight bands on a moving coated web, including directing plural fluid streams against the web to move portions of the adhesive coating to cause constructive waver interference of such portions thereby to increase the coat weight in the area of such portions.

Another aspect relates to a label material, including a support surface, a removable sheet-like material, adhesive material on the removable sheet-like material for adhering the sheet-like material to another surface, the adhesive material also retaining the sheet-like material to the support material while permitting selective removal therefrom, and areas of reduced adhesive coat weight across the sheet-like material.

Another aspect relates to a method for forming reduced adhesive coat weight at selected areas of a moving web, including directing a stream of fluid from a nozzle at the web, and moving the area of impingement of the fluid against the web across the surface of the web.

Another aspect relates to a method of forming reduced coat weight bands on hot melt adhesive coated web material, including directing fluid at a sufficiently high temperature to cause adhesive material to flow away from the area of impingement of the fluid.

Another aspect relates to an apparatus for forming bands of reduced coat weight of a coating on a moving surface, including a fluid source supplying a fluid flow, and a controller to direct the fluid flow to selected locations of the surface to reduce the coat weight of the coating at such locations.

Another aspect relates to apparatus for forming bands of reduced coat weight of a coating on a coated web, including supply means for supplying fluid, directing means for directing a stream of fluid from the supply means toward the web, and directing means including nozzle means having a relatively small outlet aperture for directing a relatively narrow width stream of fluid toward the web compared to the width of the web to impinge on the web to reduce the coat weight over a relatively narrow width band.

Another aspect relates to label material, including coating means for providing adhesion, support means for supporting said coating, a removable sheet-like material means for application to another object, said coating means comprising adhesive means on said removable sheet-like material means for adhering the sheet-like material means to another surface, said adhesive means also retaining said sheet-like material means to said support means while permitting selective removal therefrom, and areas of reduced coat weight of said coating means across the sheet-like material means.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but several of the various ways in which the principles of the invention may be employed.

Although the invention is shown and described with respect to the embodiments below, it is obvious that equivalents and modifications will occur to others skilled in the art upon the reading and understanding of the specification. The present invention includes all such equivalents and modifications, and is limited only by the scope of the claims.

BRIEF DESCRIPTION OF THE DRAWINGS

In the annexed drawings:

FIG. 7 is a fragmentary schematic end elevation view of web material with air banding of coating material thereon having a section with low coat weight;

FIGS. 8A–8E and FIG. 9 are a table and graphs representing various parameters during exemplary runs practicing the invention and representing the areas of low and high coat weight material and separate ridge areas therebetween depicting the profile similar to that shown in FIG. 7;

DESCRIPTION

Figure 1:
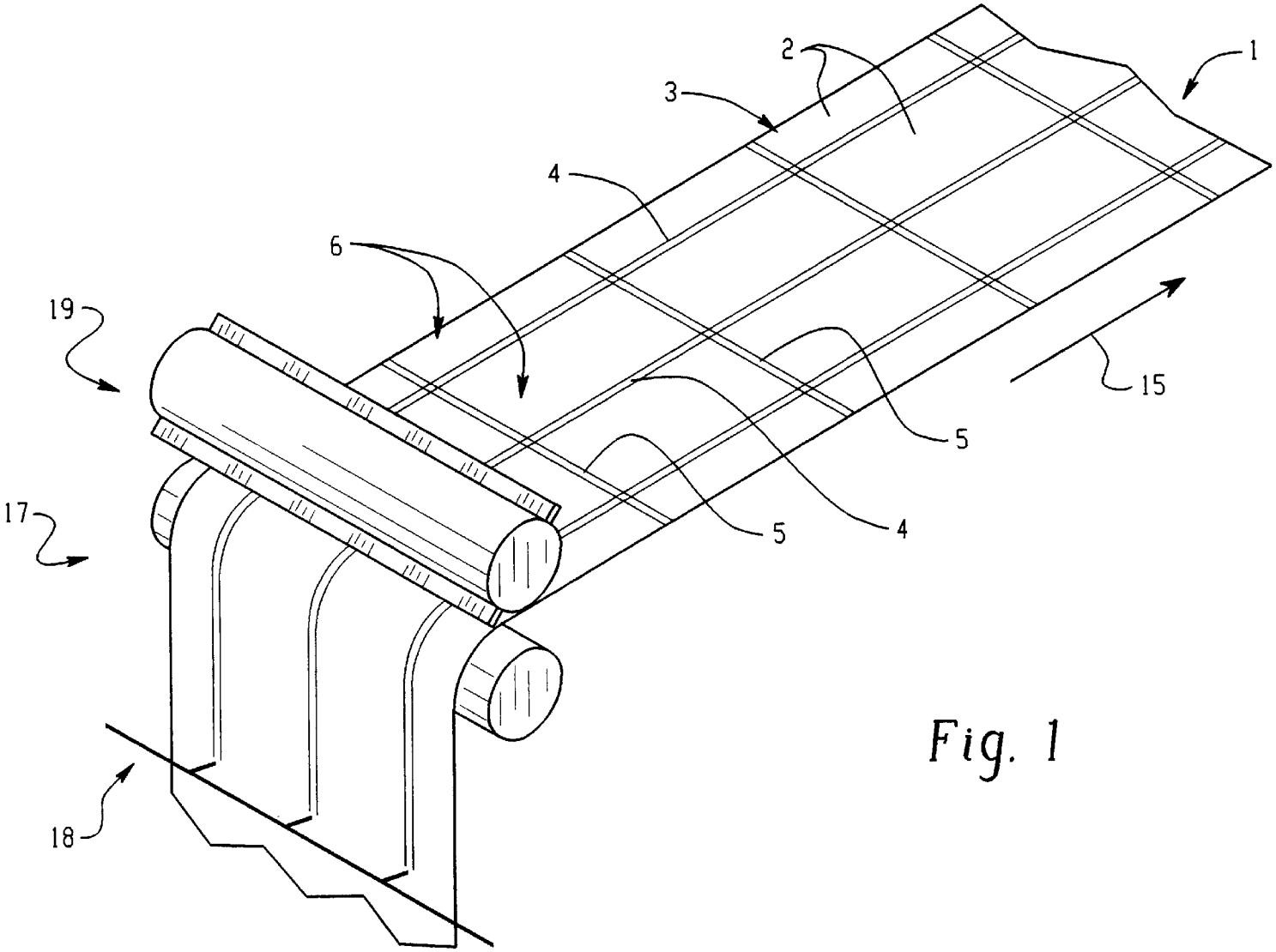
FIG. 1 is a fragmentary schematic illustration of a machine direction and cross direction air banding apparatus and method in accordance with an embodiment of the invention.
Figure 2:
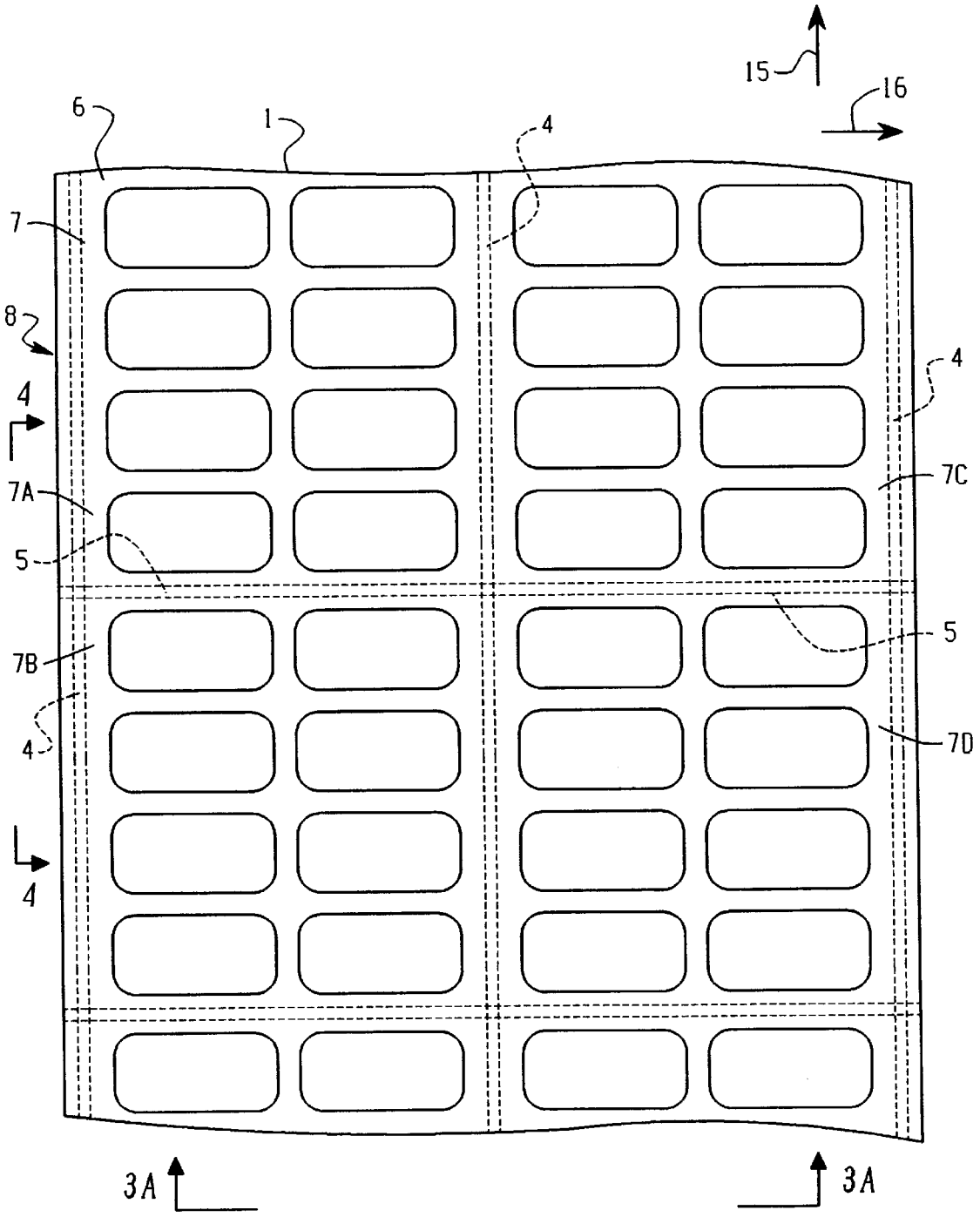
FIG. 2 is a fragmentary schematic illustration of an example of adhesive coated sheet material in accordance with an embodiment of the invention, the sheet material being in the form of a release sheet and a plurality of labels thereon, the sheet material being banded in the machine direction and cross direction.

Referring in detail to the drawings, wherein like parts are designated by like reference numerals in the several figures, and initially to FIGS. 1 and 2, an adhesive coated web 1 is shown. The web 1 has a plurality of areas or regions 2 of relatively high adhesive coat weight (sometimes referred to as "coating weight") material 3 and bands 4, 5 of relatively low adhesive coat weight. In FIG. 1 respective rectangular areas 6 represent areas of the web that ultimately will be sheeted (i.e., cut into respective smaller size sheets 7 of the finished product 8 in which the web 1 is used, as is shown in FIGS. 2–4).

An exemplary sheet size cut from the web 1 may be 8 ½ inches by 11 inches, may be the size of A-4 paper, or may be some other desired size. Four sheets 7A–7D of such finished product are shown schematically in FIG. 2.

Figure 4:
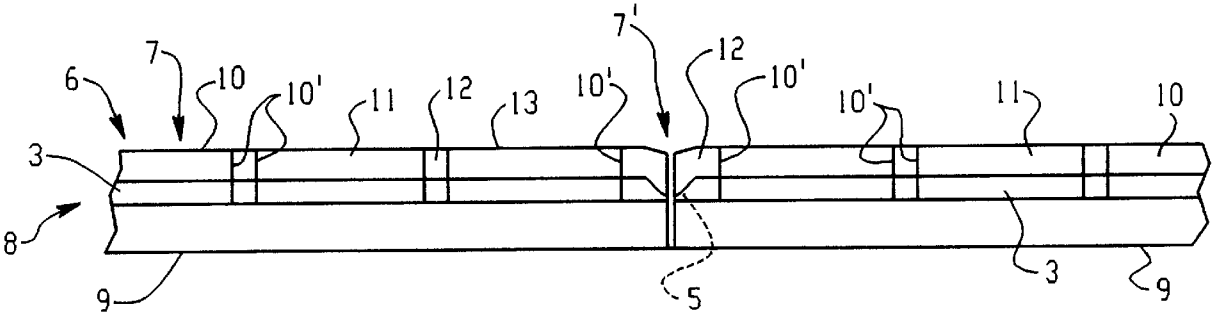
FIG. 4 is a fragmentary elevation view of the web material of FIG. 2 looking in the direction of the arrows 4—4 thereof.
Figure 3B:
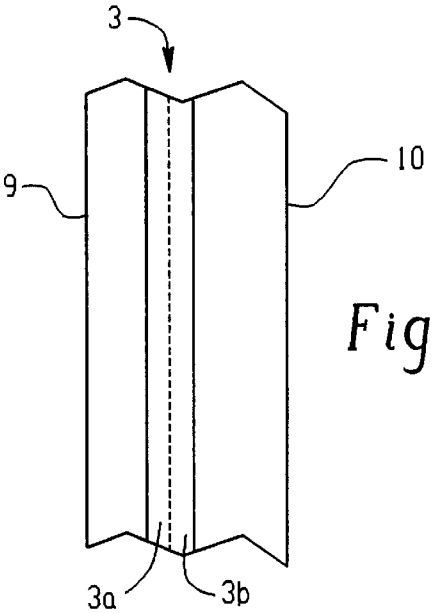
FIG. 3B is a fragmentary elevation view of the web material similar to the illustration of FIG. 3A and looking generally in the direction of the arrows 3A—3A of FIG. 2, but showing a multiple layer coating.
Figure 3A:
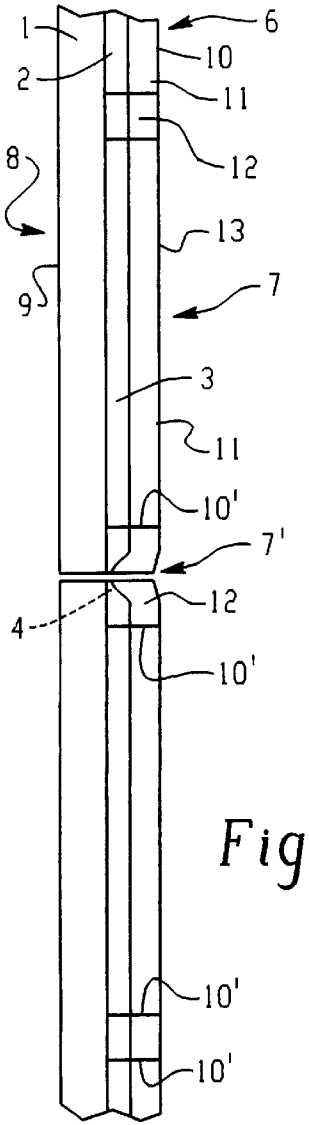
FIG. 3A is a fragmentary elevation view of the web material of FIG. 2 looking in the direction of the arrows 3A—3A.

Referring briefly to FIGS. 3A, 3B and 4, the coated web 1 includes a web material 9 and the coating 3 thereon. The web material 9 sometimes is referred to simply as a web and it may be formed of plastic material, paper material or some other material. The coating 3 may be an adhesive material or some other material. In an embodiment described herein the web material 9 may be a support sheet which sometimes is referred to as a "liner", and the liner may have a release coating (now shown) thereon.

As is illustrated schematically in FIGS. 2–4, in a finished product 8, sometimes referred to as a decal sheet, label sheet, or some other name, a face material 10 is applied as part of a sandwich-like assembly including, for example, the liner 9 with release coating, and an adhesive coating 3.

Sometimes the face material is referred to as face stock or label stock. The face material 10 may be cut, e.g., die cut, to separate respective labels 11 from each other and from a waste matrix material 12. If desired, the exposed surface 13 of the labels 11 from each other and from a waste matrix material 12. If desired, the exposed surface 13 of the labels 11 may be printed with information, designs, etc., e.g., by laser printer, pin printer, ink jet printer, or some other printer or the like. The labels 11, with adhesive coating 3 thereon, may be removed, e.g., peeled, from the liner 9 and applied to another surface or otherwise used. The waste matrix 12 may be removed from the liner 9 if desired.

It will be appreciated that although the coating described herein is referred to as an adhesive material, adhesive coating, adhesive, etc., other 10 coatings may be used in accordance with the principles of the invention. The coating may be a single layer 3, as is shown in FIG. 3A, or may be multiple layers 3*a,* 3*b,* as is shown schematically in FIG. 3B. The coating material may be a fluid, such as a liquid, gel or the like. However, the coating may include various ingredients, solid or otherwise, in the fluid, to provide desired characteristics, such as adhesion, color, etc. The coating may be any coating which functions generally in the manner described or suggested herein or equivalents thereof. Further, regarding the nature of the adhesive material, several different types conventionally are used, such as emulsions, sometimes referred to as wet coating, hot melt coating, silicone coating, and possibly other coatings. The invention may be used with various adhesive materials and several examples are presented in the description below.

Reference is made to "fluid" herein. Fluid usually is a material that can flow. Several non-limiting examples are gas, liquid, gel, a mix of two or more of those materials, or a mix of one or more of those materials with a solid. The fluid such as fluid coating, may eventually set up to form a solid due to one or more circumstance or process, such as drying, curing, cross-linking or some other circumstance or process. A gaseous fluid, such as a fluid directed toward the web 1 to form areas or bands 4, 5 of reduced coat weight (FIGS. 1–4 and described further below), may be, for example air, an inert gas, another gas, a mix of two or more of those materials, or a mix of one or more of those materials with a solid, such as solid particles, and/or with a liquid.

As is seen in FIG. 1, the web 1 is moved in the direction of an arrow 15. This direction sometimes is referred to as the machine direction or longitudinal or vertical direction, and it refers to the direction that the web travels or is moved through the apparatus for manufacturing the web. A cross direction or horizontal direction is represented by an arrow 16, which is generally transverse to the machine direction. However, the cross direction may be somewhat askew or diagonal across the web surface but in any event is not parallel to the machine direction 15. In an embodiment described in detail herein the cross direction is perpendicular to the machine direction.

In FIG. 1 an apparatus 17 for forming in the adhesive coating 3 on the web 1 the respective machine direction and cross direction bands 4, 5 of low adhesive coat weight is shown schematically. The apparatus 17 forms the bands 4, 5 by directing fluid against the web to move coating material thereon or to thin the coating material 3 on the web 1 at the areas where the fluid impinges against the web 1 and coating 3. In an embodiment of the invention the fluid is air, which is described in the embodiment below. However, it will be appreciated that other fluids may be used as may be desired.

As is seen in FIG. 1, the apparatus 17 includes a machine direction air banding portion 18, which creates the machine direction bands 4 of low adhesive coat weight. The apparatus 17 also includes a cross direction air banding portion 19, which produces the cross direction bands 5 of low adhesive coat weight. These machine portions 18, 19 will be described in greater detail below.

Referring to FIGS. 2–4, an embodiment of finished product 8 as plural labels 11 cut from face material 10 with adhesive coating 3 and liner 9 is shown. In this embodiment the liner 9 is the web 1. The locations 10' of die cuts through the face material 10 and adhesive 3 to form labels 11 is shown schematically in FIGS. 2–4. The web 1 has relatively high adhesive coat weight areas 2 and relatively low adhesive coat weight bands 4, 5, respectively, in the machine direction and cross direction. The web 1 and finished product 8 may be cut into respective sheets 7 by die cutting along respective low coat weight bands 4, 5. The locations of sheeting cuts to separate sheets 7 are represented by lines 7' in FIGS. 3 and 4. By providing the low coat weight bands in the area of locations 10' where die cutting is to occur, the amount of adhesive that may adhere to the knife or die would be reduced relative to cutting where there is a relatively high adhesive coat weight area 2. Also, by providing relatively low adhesive coat weight at the areas of locations 7', such as at edges of the respective sheet 7 after they have been cut from the web 1, there would be less adhesive at the edge areas of the sheets and, therefore, less likelihood of damaging rolls or the like in a laser printer or some other printer device, etc.

Figure 5:
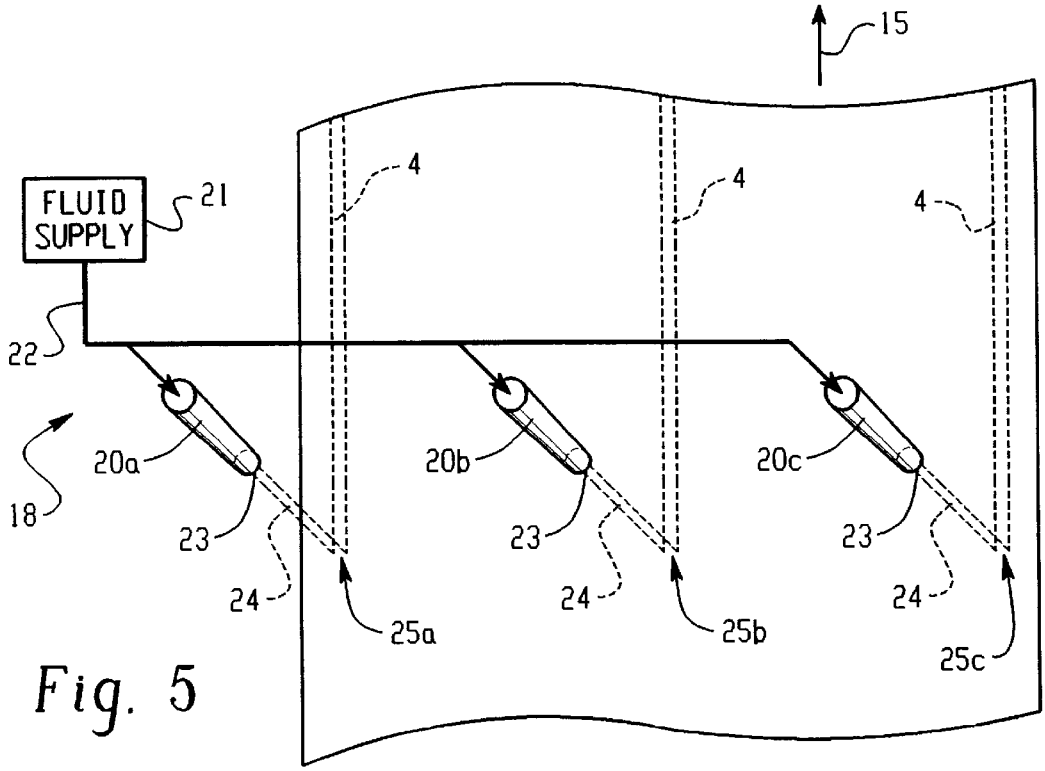
FIG. 5 is a schematic illustration of air banding apparatus and method to effect air banding of coated web material in the machine direction.

Turning to FIG. 5, the machine direction air banding apparatus 18 is shown including three nozzles 20*a*, 20*b*, 20*c*. The nozzles may be identical or they may be different from each other, depending on the output flow characteristics and characteristics of the machine direction bands 4 formed thereby. Each nozzle receives a supply of air (or other fluid) under pressure from a fluid supply 21 via a connection 22, and each nozzle has an outlet 23 from which a stream of air 24 is directed to impinge at a respective location or area 25*a*, 25*b*, 25*c* on the web 1. The flow rate, size of the cross sectional area of the flow stream 24, and angle of impingement on the web 1 may affect the size and shape characteristics of the respective low coat weight bands 4. Several examples are presented herein wherein such parameters may be varied to achieve respective results. It has been found that the size of the outlet 23, sometimes referred to as nozzle diameter, for example, when the outlet is round, appears to have the greatest impact in determining the width of the band 4, the angles of impingement and flow rates having less consequence on the size and shape of the bands 4, provided that the angles and flow rates are sufficient to provide the creation of a desired band.

Figure 6:
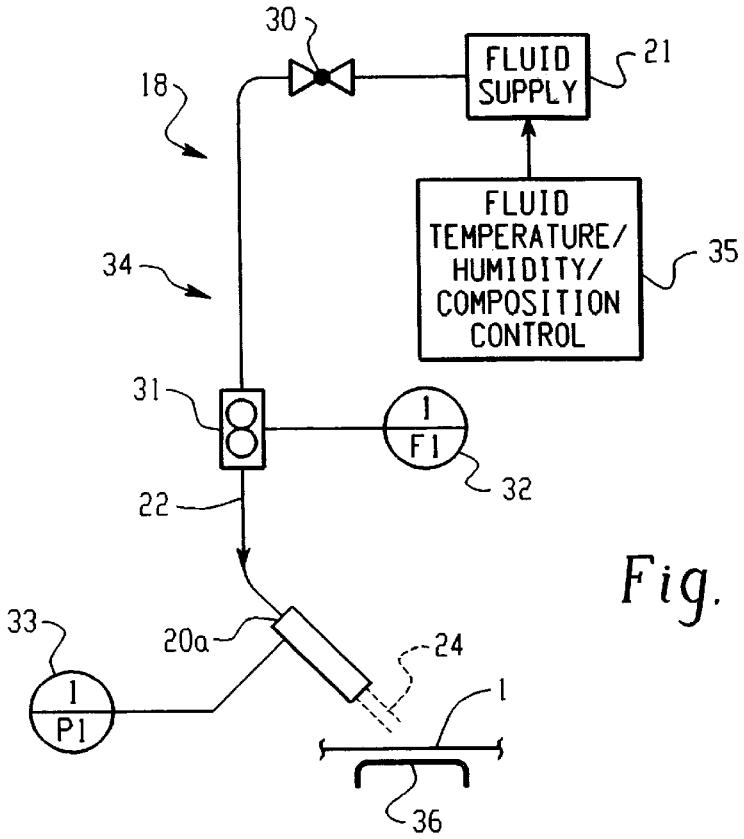
FIG. 6 is a fragmentary schematic illustration of a flow control and monitoring system for the air banding apparatus of FIG. 5.

In FIG. 6 is shown further detail of the machine direction air banding portion 18 of the apparatus 17. Pressurized air from the fluid supply 21 is directed via a pressure regulator 30 and a flow meter 31 to an air nozzle, for example, nozzle 20*a*. The flow meter 31, including an air flow sensor and control device 32, may be used to control the flow of air to the nozzle. A nozzle static pressure gauge and control 33 may be used to monitor and to control the pressure of the air supplied to the nozzle 20*a*. The regulator 30 also may control pressure of the pressurized air supplied in the flow path 34 via the flow meter 31 and pressure gauge 33 to the nozzle 20*a*. The air stream 24 directed to the web 1, therefore, may be effectively controlled by adjusting the regulator 30, flow meter 31 and pressure gauge 33, and such air stream also may be controlled by selecting a prescribed outlet diameter for the nozzle 20*a*.

If desired an adjustment and control apparatus 35 may be used to affect the fluid in the fluid supply 21, for example, or elsewhere in the apparatus of the invention. The apparatus 35 may heat, cool or otherwise control temperature of the fluid directed to the web; and in such case may be a conventional heater or cooler/chiller device. The apparatus may humidify, dehumidify or otherwise control the humidity of the fluid; and in such case may be a conventional humidifier, dehumidifier or humidity control device. The apparatus 35 may add, filter or control ingredients or composition of the fluid, such as, for example, the ingredients, formulation or composition of fluid components of the fluid; and in such case a conventional filter, getter, combiner, etc. may be used. Such control may enhance or control properties of the coating on the web. For example, heated air may facilitate melting or maintain melted condition of a hot melt coating; air of a given temperature may help achieve desired viscosity characteristics; ingredients or composition of the air may affect viscosity, curing, drying, etc. These are only several of many controllable affects. As will be appreciated, the apparatus 35 may be any of various devices. For example, a heater or chiller may be used to affect temperature and along with a temperature detector and controller can control such temperature. Similarly, a humidifier or dehumidifier can be sued to control humidity; and a filter, metering device, etc. may be used to control composition of the fluid.

In various embodiments of the invention, the outlet 23 from the nozzle 20*a* may be generally circular, although it may be of some other shape, if desired. For a circular shaped nozzle outlet 23 the diameter of the outlet may vary from, for example, on the order of about 1/64 inch to about 1 ½ inch, and more preferably on the order of from about 1/32 inch to about 3/16 inch, 3/16 inch, or it may be larger or smaller. The distance between the nozzle outlet 23 and the web 1 may be on the order of from about 1/16 inch to about 1 inch, and more preferably from about ⅛ inch to about ½ inch, although in some circumstances that gap distance may be greater or smaller. Also, the nozzle angle, i.e., the direction that the air stream 24 impinges on the web may be from on the order of from about −60°, i.e., facing upstream on the web, to 0°, to about +60°, i.e., facing downstream on the web, and more preferably from on the order of about −25° to about +25°.

The angle is measured from a normal to the surface of the web at the point of impingement by the fluid jet or stream, whereby 0° is perpendicular to the web surface.

In FIG. 6 roll, anvil-like device, plate, or other support schematically shown at 36 may be used to provide support behind the web 1 where the machine direction air streams impinge on the web. The support increases stability and consistency of the coating and reduced coat weight bands.

In FIG. 7 is an enlarged end elevation section type view of a web 1 having a coating 3 thereon. The coating 3 has a relatively high adhesive coat weight area 2 and a relatively low adhesive coat weight band or area 4. Respective crests 40, 41 are between the respective relatively high and relatively low coat weight areas 2, 4. The crests 40, 41 may be from the coating material that is moved by the air stream from the low coat weight area 4 toward the area of high coat weight 2. The width of the low coat weight area has been found to depend in large part on the diameter of the nozzle outlet 23. The width between crests 40, 41, of course, is larger than the width of the low coat weight area or band, as there is an increase in thickness or coat weight of material moving from the low coat weight area 4 to the top of respective crests.

Several tables and charts shown in the drawings depict the results of examples of several embodiments of the invention in which the effect of nozzle outlet diameter, nozzle outlet spacing from the web, and nozzle angle relative to the web are related. A significant factor influencing the band width, i.e., the width of the low coat weight band, was nozzle diameter.

The table in FIG. 8A contains the data from several examples where the low coat weight bands in the machine direction were visible and the air flow from the nozzle was measured. The nozzle static pressure levels for the data depicted in the table were 6 psig and 10 psig. The data graphed is the width of the visible low coating weight band having a coating weight of less than or equal to 12 gsm (grams of coating per square meter) rather than the width between the crests 40, 41 (FIG. 7, for example).

Figure 8B:
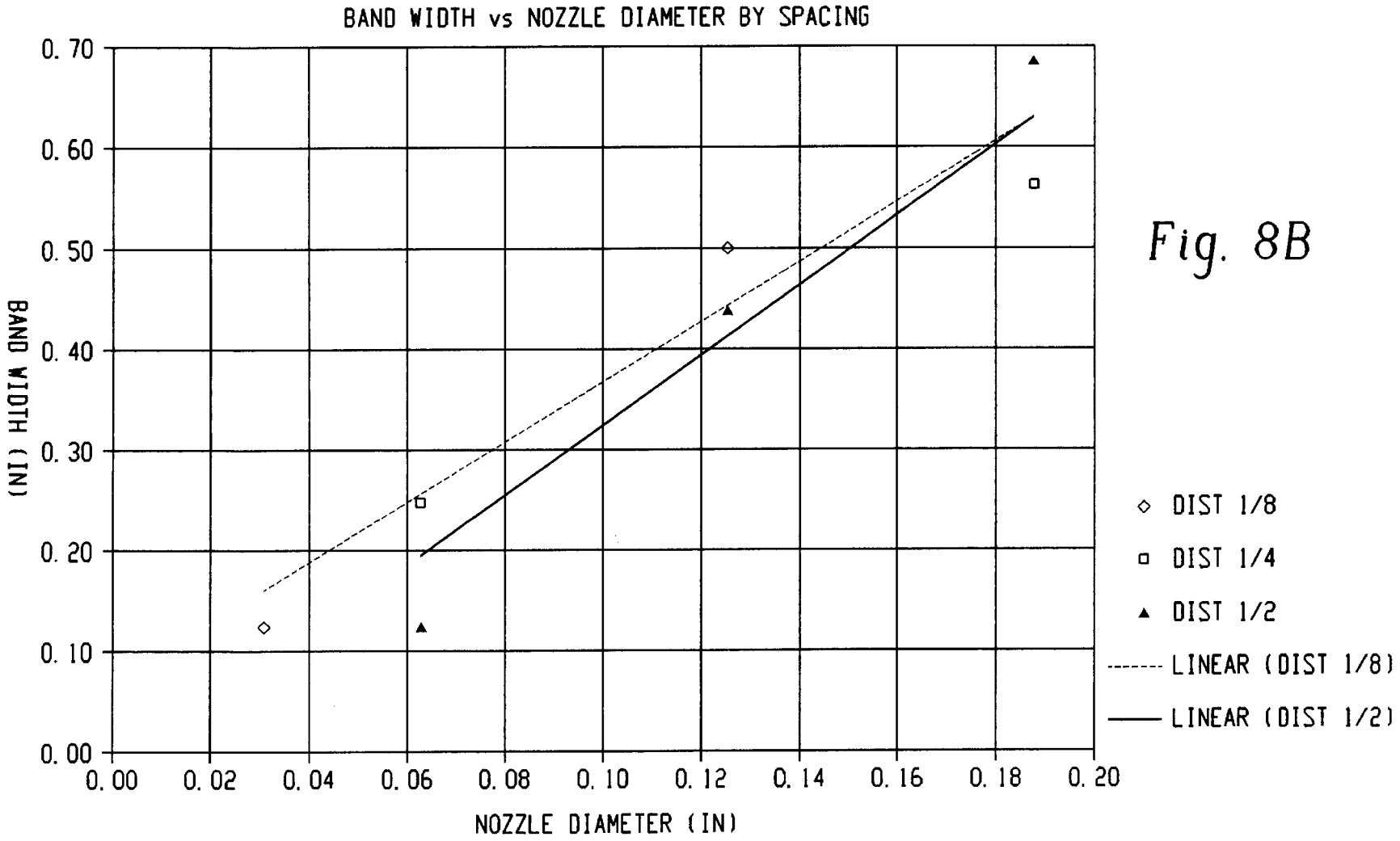

In the chart of FIG. 8B, band width versus nozzle diameter is shown.

The data is grouped by nozzle spacing (distance of the nozzle outlet 23 from the coated web). In this example there is a correlation between nozzle outlet diameter and band width, and there is relatively little effect of nozzle spacing.

Figure 8C:
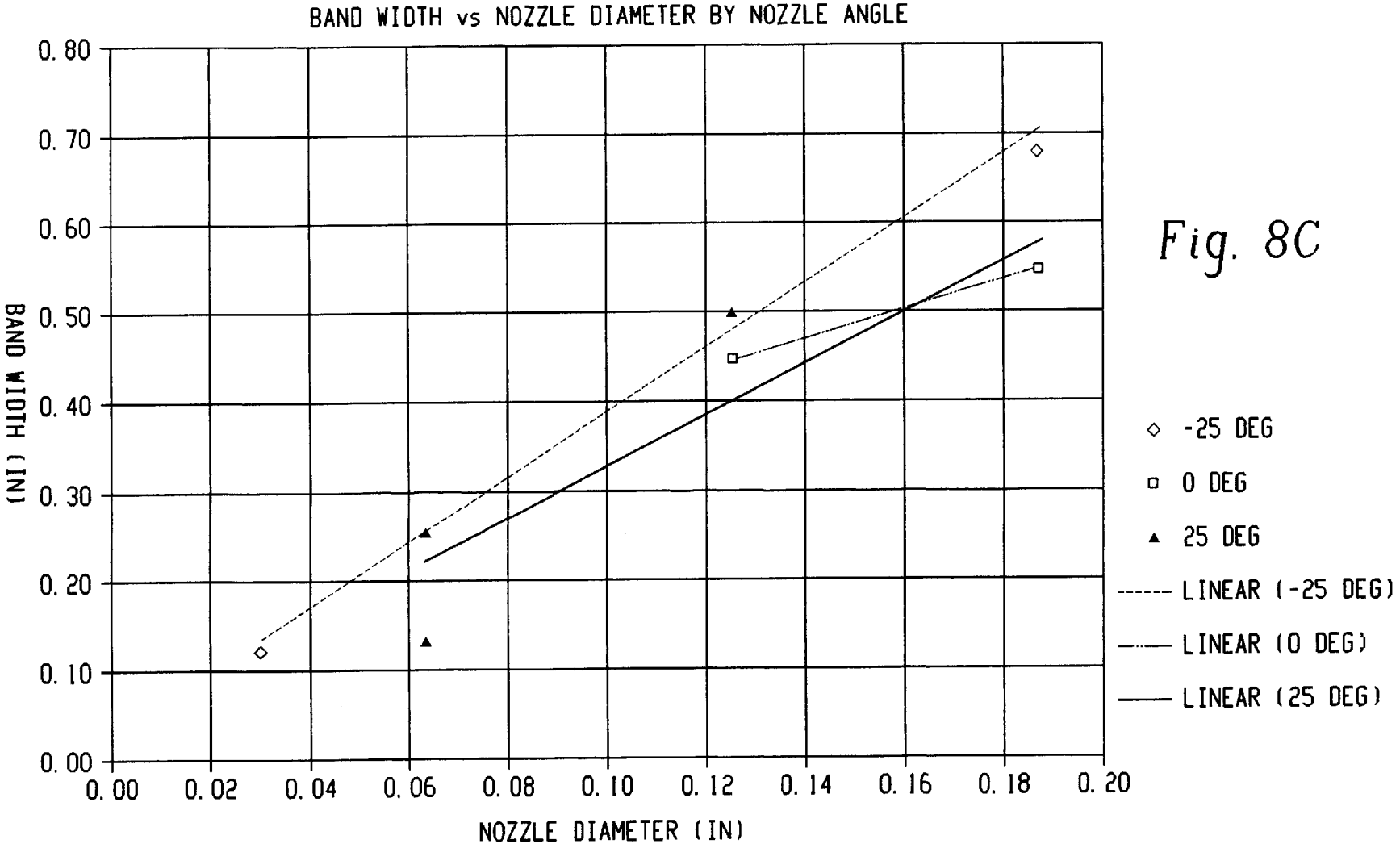

The chart shown in FIG. 8C graphs band width versus nozzle diameter, and this time the data is grouped by nozzle angle, i.e., the angle of impingement of the fluid stream on the coated web. The nozzle angle effect on band width appears to be relatively small compared to the effect of nozzle diameter on band width.

Figure 8D:
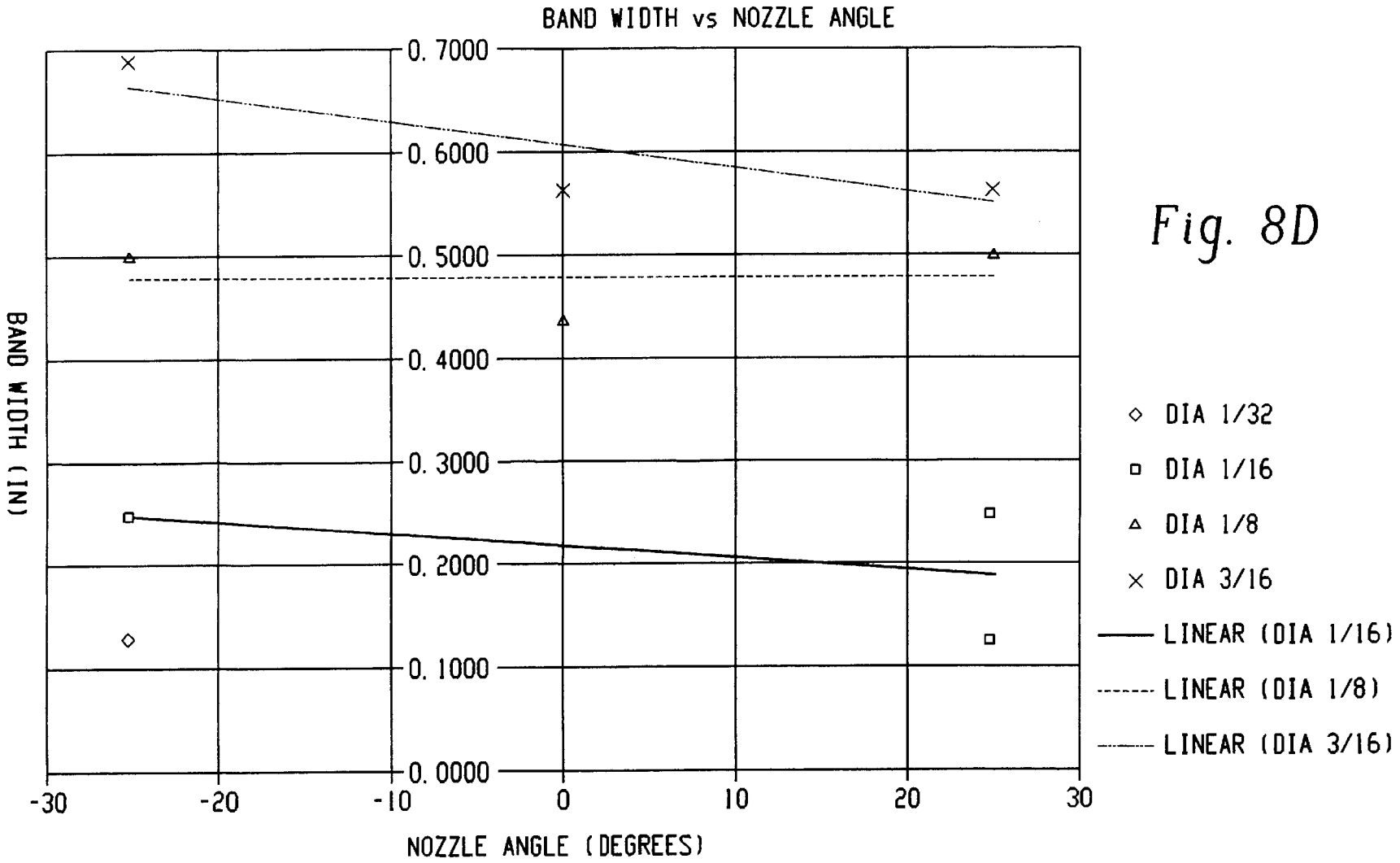

The chart in FIG. 8D graphs band width versus nozzle angle and the data is grouped by nozzle outlet diameter. From this data it is clear that the nozzle diameter is a significant factor in band width, as is evident by the step change between respective groups.

Figure 8E:
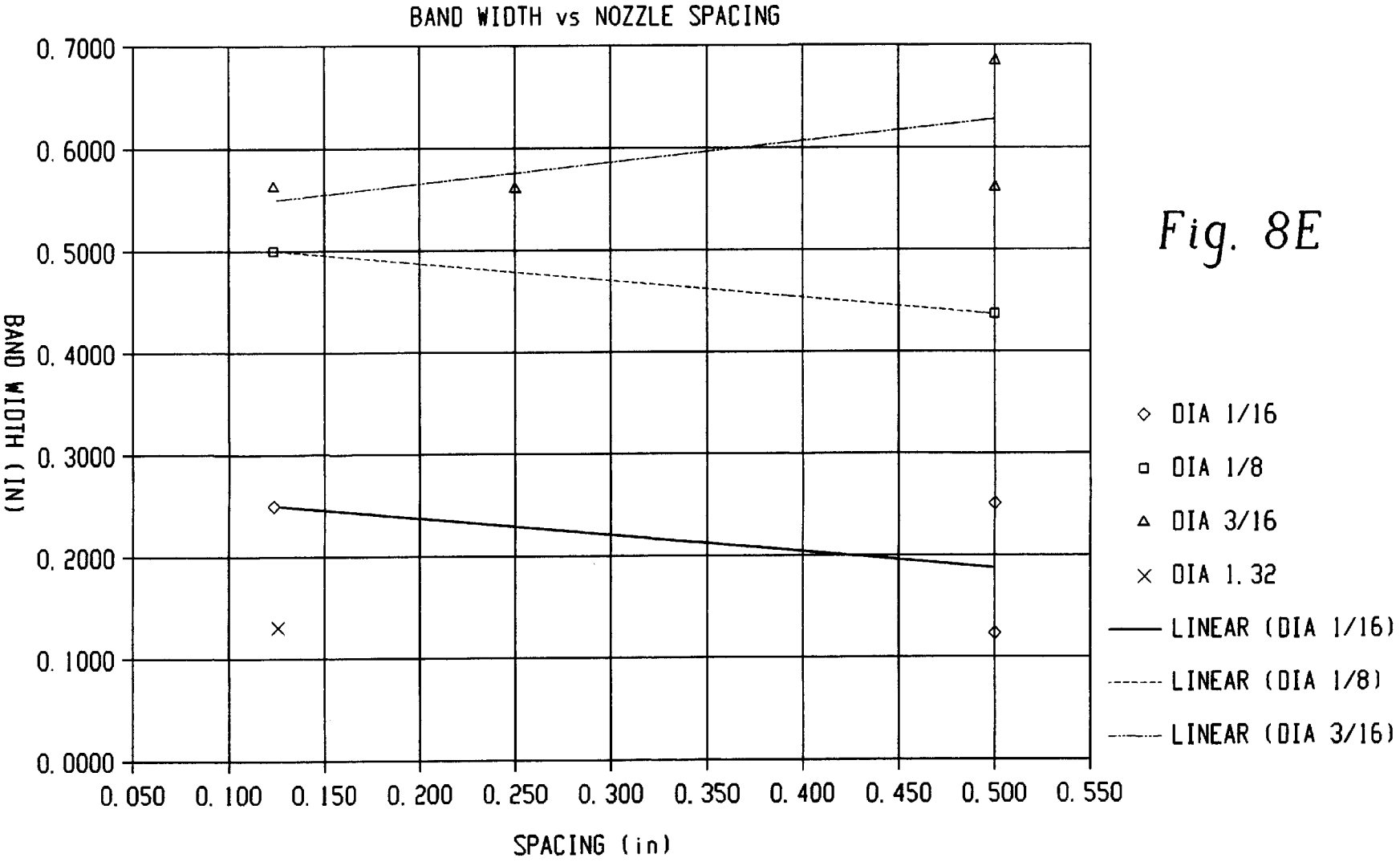

The chart of FIG. 8E graphs the band width versus nozzle outlet spacing from the coated web and also is grouped by nozzle outlet diameter. Again, it is evident that a significant influential factor is nozzle outlet diameter, as is shown by the step change between respective groups.

In the above-mentioned examples depicted in FIGS. 8A–8E, a minimum coating weight of 10 to 12 gsm is desired to achieve the low flow edge characteristics needed by sheet material intended to be used in a laser printer.

To make uniform low coating weight bands in the machine direction 7 of less than or equal to about 12 gsm, there appears to be an air velocity threshold that must be reached. This threshold changes based on nozzle diameter.

However, examples of air velocity threshold for good low coating weight bands have been found to range from on the order of about 18,000 fpm (feet per minute) for a nozzle having a 3/16 inch nozzle diameter to about 50,000 fpm for a 1/32 inch nozzle outlet diameter.

Figure 9:
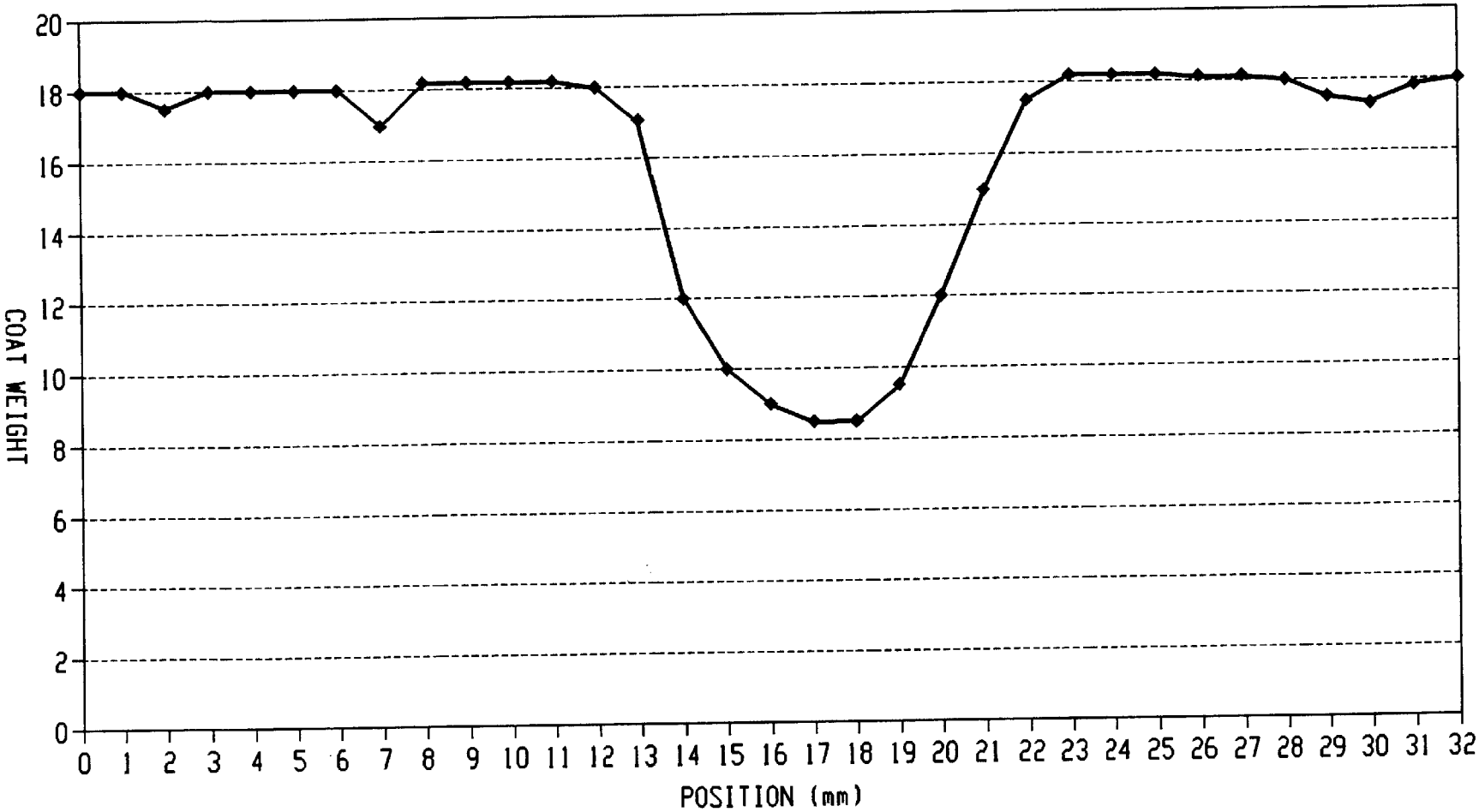

FIG. 9 is a graphical representation of the approximate coat weight relative to position on the web 1 for an exemplary run, the parameters of which are shown in FIG. 8A.

The air banding to provide low adhesive coat weight bands in the machine direction and in the cross direction is operative for various types of adhesive materials. When the adhesive material is an emulsion that is relatively fluidic in character of relatively low viscosity on the web, the air flow moves the material away from the impingement area 25*a,* etc., and creates the low coat weight area 4. Preferably the viscosity of the emulsion material is sufficient such that it does not tend to move from the respective crests 40, 41 (FIG. 7) back into the area of low coat weight. The air impingement also may be such that it tends to assist in increasing the viscosity of the adhesive material as it moves the adhesive material toward the crests 40, 41. Such increase may be effected, for example, by using air flow of a temperature that is elevated above ambient temperature to expedite drying, curing or some other effect that increases viscosity to achieve the specified function.

Characteristics of the impinging air may have other effects or impacts on the coating itself, processing of the coating, such as drying, curing, etc. Such characteristics of the impinging air may be, for example, humidity, composition (as was mentioned above the impinging fluid may be a fluid other than air or in addition to air), etc. The air flow may assist in causing a skin or skin-like characteristic to the exterior surface of the coating material at the crests 40, 41, whereby the skin tends to have increased rigidity and resistance to flow, thereby retaining the coating material in the areas of the crests and preventing the adhesive material from re-flowing back into the low coat weight area 4. In an embodiment of the invention using a silicone adhesive coating material, the operation would be similar to that described herein. Also, in an embodiment of the invention in which the coating material is a heat melt or thermoplastic, the impinging air stream may be of a sufficiently high temperature to reduce the viscosity of the hot melt material enabling it to flow out of the area where low coat weight is desired, such as area 4, for example, and the adhesive material tends to cool sufficiently at the areas of the crests 40, 41, whereby viscosity increases and the tendency to re-flow back into the area of low coat weight is avoided. These characteristics and features also are applicable to the air banding discussed below for cross direction low coat weight bands 5.

Figure 10:
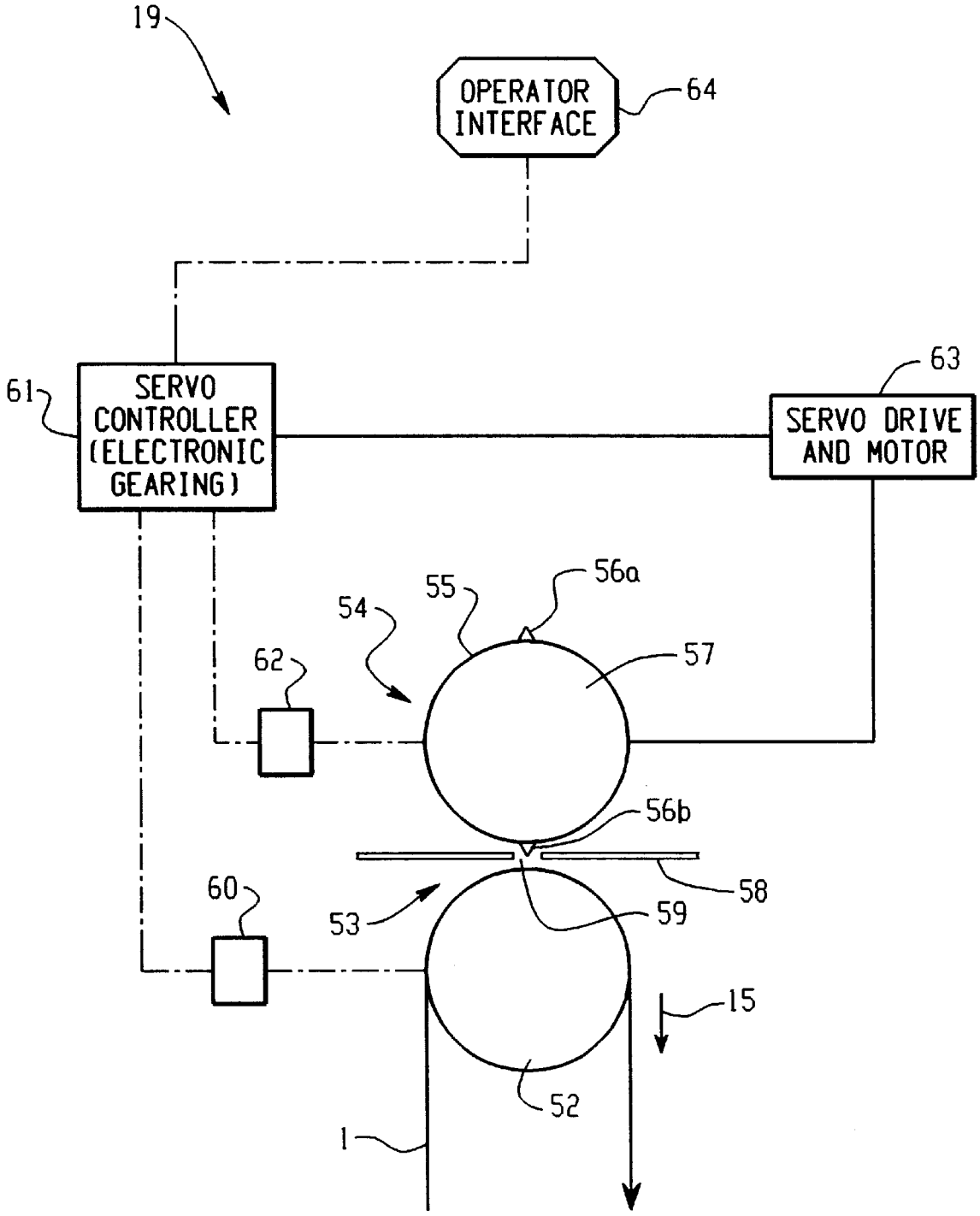
FIG. 10 is a schematic illustration of an apparatus for forming cross direction bands of low coat weight material on a web in accordance with an embodiment of the invention using a rotating air blade type nozzle.

Referring, now, to FIG. 10, an embodiment of cross direction low coat weight band forming portion 19 of the apparatus 17 is shown schematically.

The coated web 1 is directed to and from a backup roll or anvil roll 52. The roll 52 conveys the web to an area 53 where a strip-like flow of air is directed across at least part and preferably across the entire width of the web in a direction transverse or substantially transverse to the machine direction 15. A rotating nozzle system 54 applies the strip-like air stream at selected locations or at spaced-apart locations on the coated web. More specifically, the rotating nozzle system 54 is but one example of several different types of nozzle systems that may be used to apply across the web a strip-like air stream that moves adhesive material to form a low adhesive coat weight area or band 5 in the cross direction, i.e., across the web. The effect of the strip-like air stream is similar to the effect of the narrow air stream directed by respective nozzles 20*a,* etc., to form the machine direction low adhesive coat weight bands 4 described above. Thus, the general shape and characteristics of the cross direction low adhesive coat weight bands 5 are generally similar to the machine direction bands 4.

In the embodiment illustrated in FIG. 10, the rotating nozzle system 54 includes a rotating drum-like device 55 with a pair of outlet orifices 56*a,* 56*b* from which air may exit the interior 57 of the drum 55. The drum 55 may be cylindrical (or some other shape, if desired) and the orifices 56*a,* 56*b* extend generally in parallel to the axis of the drum 55. A shield or baffle 58 is between the drum 55 and the web 1, which is positioned on the roller 52.

The shield 58 includes an aperture 59 that is elongate generally in parallel with the direction of the axis of the roller 52 and the axis of the drum 55 and is relatively narrow in the machine direction.

The nozzle system 54 forms the low adhesive coat weight cross direction bands at spaced intervals along the web 1. The other spaced intervals may be uniformly spaced or they may be other than uniformly spaced. For uniform spacing of the cross direction bands, operation of the nozzle system 54 and movement of the web 1 preferably are coordinated and more preferably are synchronized with reasonable precision. To effect such coordination a web position reference encoder 60 detects the position of the web 1, for example, by monitoring rotation of the roller 52 and provides information concerning such position to a servo controller 61. A web position banding encoder 62 detects the position of the orifices 56*a,* 56*b* relative to the web 1, for example, by monitoring the rotational position of the drum 55 and apertures thereof. The output from encoder 62 also is directed to the servo controller 61. The output from the servo controller 61 in turn is directed to a servo drive and motor 63 which rotates the drum 55, then, in synchronism with the motion of the web 1 and/or rotation of the roll 52. If desired, an operator interface 64 may be used to provide adjustments in the operation of the servo controller 61 and operation of the drum 55. For example, the operator may provide inputs to adjust or fine tune relative positions of the orifices to the web, etc.

In operation of the cross direction air banding apparatus 19, the rotational motion of the roller 52 and rotational motion of the drum 55 are monitored by the respective encoders 60, 62. The servo controller 61 controls the servo drive and motor 63 accordingly to rotate the drum 55 in synchronism with the roller 52. As the drum 55 rotates, periodically one of the orifices 56*a,* 56*b* aligns with the aperture 59 in the shield 58 to direct air flow across the width of the web 1 forming the low adhesive coat weight band 4 in a cross direction.

The drum 55 rotates counterclockwise or clockwise—moving the orifices 56*a,* 56*b* in the same direction or opposite direction relative to the direction of movement of the web 52 past the aperture 59 of the shield 58.

Figure 11:
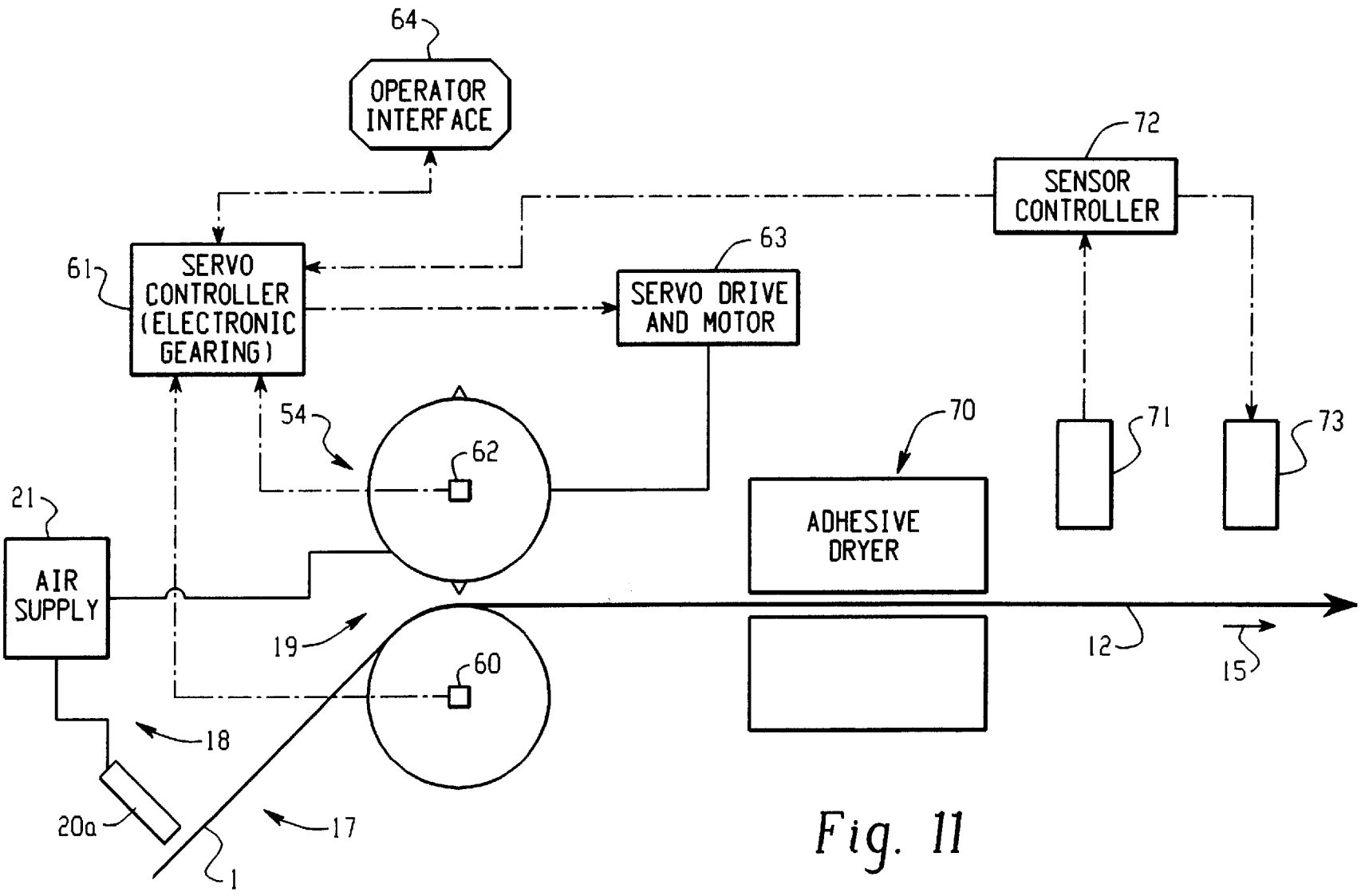
FIG. 11 is a more complete block diagram of a monitoring and control system for performing the cross direction bands of low coat weight on a moving web similar to the apparatus of FIG. 10.

In FIG. 11 the apparatus 17 including both the machine direction air banding apparatus 18 and the cross direction air banding apparatus 19 are illustrated in conjunction with a web 1 being manufactured thereby. The web is moved in the machine direction 15 by drive rolls (not shown). An adhesive coating is applied to the web 1 upstream of the machine direction air banding apparatus 18. Air from the air supply 21 is directed to respective nozzles 20*a,* for example, to impinge on the web to form the low adhesive coat weight machine direction bands 4. In the cross direction air banding apparatus 19 the nozzle system 54 periodically applies a cross direction low adhesive coat weight band in the coating on the web. Coordination of the web speed or position and the cross direction banding apparatus 19 is provided by the respective encoders 60, 62, the servo controller 61 and the servo drive motor 63. The coated web with the low coat weight bands is directed through a dryer 70 where the coating is dried, cured or otherwise conditioned so that it is retained on the web and does not lose its shape, e.g., the low coat weight areas 4, 5 remain. A band sensing device 71, which may be, for example, an optical sensor, an electrical impedance sensor, or some other sensor type device, may be used to detect the cross direction bands. The relative locations of the cross direction bands compared to the expected locations based on the position encoder information from the encoder 60 may be fed back by a sensor controller 72 to the servo controller 61 to provide a position trim function readjusting the synchronization of the nozzle system 54 with the web position and rotation of the web roll 52. A marking device 73 may apply marks on the web to facilitate aligning the web with a die cutting apparatus automatically or manually to cut the web into plural sheets. The marking device and the sensor may be conventional devices, such as a device to apply ink, paint or other mark to material and an optical sensor to detect such marking; and many other devices also may be used. The marking device 73 also or alternatively may be used to indicate when a portion of the web is found by the sensor 71 and sensor controller 72 to have the cross direction bands outside of acceptable tolerance locations until brought back into tolerance. Moreover, the sensor 71 may be used to sense the proper existence of the machine direction bands and the sensor controller 72 may be used to provide signals back to the servo controller 61, operator interface 64 and/or other equipment to shut down the web manufacturing when unacceptable conditions have been detected.

Figure 12:
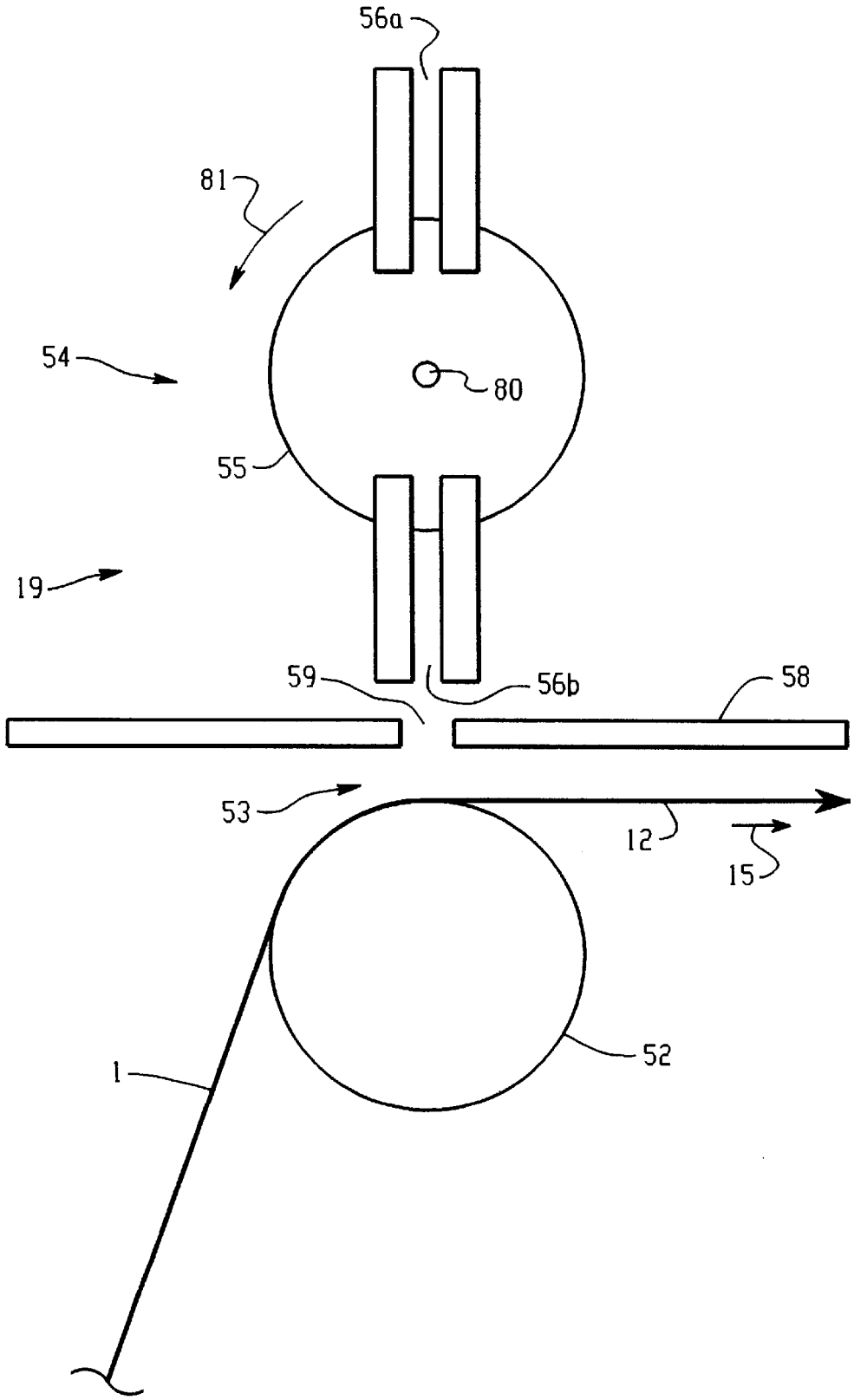
FIG. 12 is a detailed illustration of a rotating air blade and air shield for applying cross direction bands of reduced coat weight on a moving web.
Figure 13:
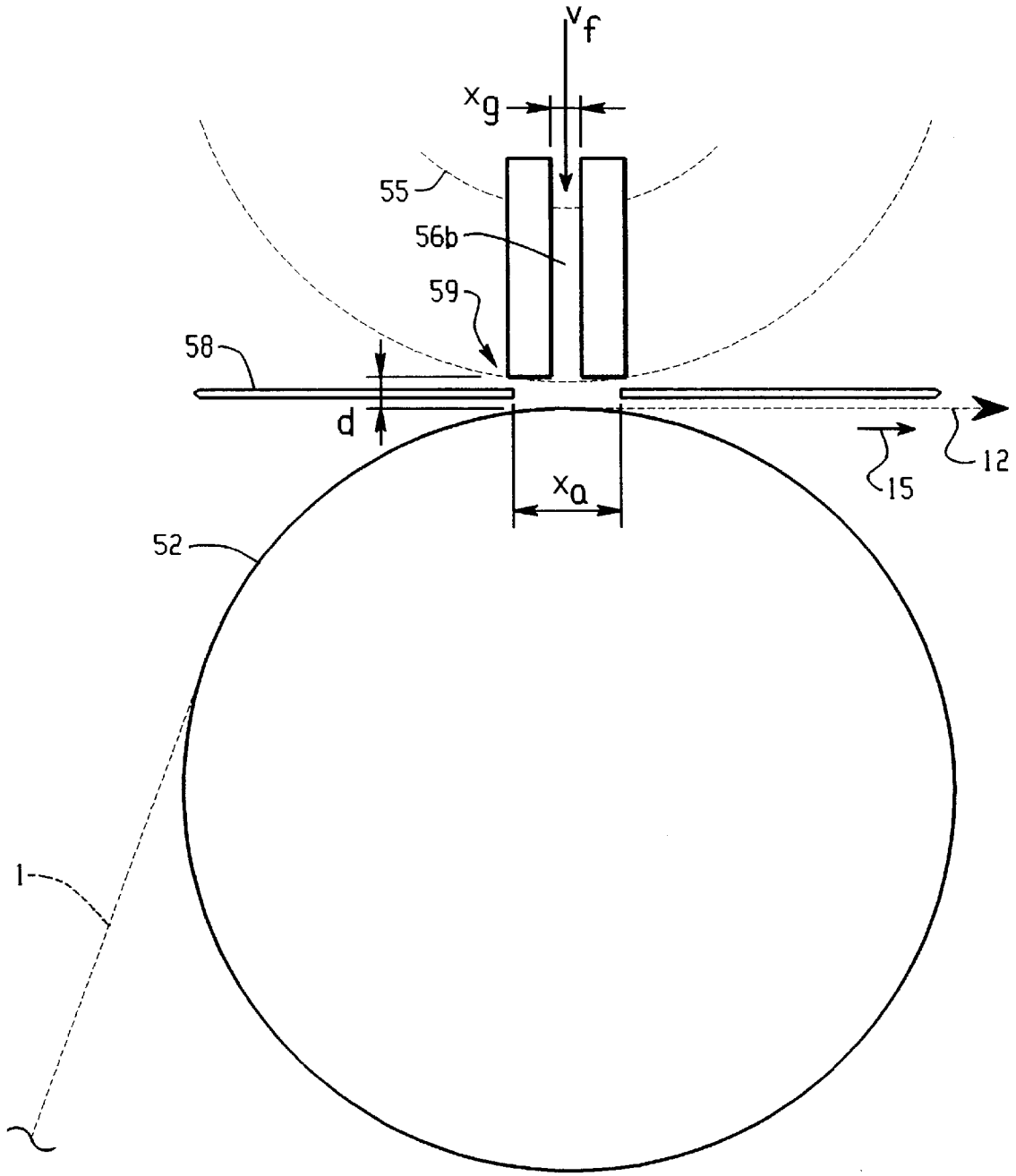
FIG. 13 is a schematic illustration of the nozzle outlet for the rotating nozzle of FIGS. 10, 11 and 12.

The nozzle system 54 is shown in greater detail in FIGS. 12 and 13. The nozzle system 54 includes the drum 55 to which a supply of air is provided.

The air in the drum 55 is delivered to the respective orifices 56*a,* 56*b,* which may be of relatively long length in a direction parallel to the axis of the drum 55 (the axis being designated at 80 in FIG. 12) and relatively narrow width in the direction of rotation of the drum 55, which is represented by the arrow 81.

Nozzle static pressure may be, as a non-limiting example only, from as low as 0.5 psig to about 110 psig, and more preferably from about 2 psig to about 20.

Various volumetric flow rates for air in the nozzle 20*a* may be employed.

Several non-limiting examples are, as follows: For example, at standard temperature and pressure, air volume requirements to obtain a low coat weight as is described herein may be on the order of about 50 CFM (cubic feet per minute) to about 600 CFM. For example, for a nozzle having a diameter on the order of about 1/64 inch, about standard temperature and pressure, using flow rates on the order of about 50 CFM to about 600 CFM, nozzle velocities in the range of 8,500 fpm (feet per minute) to greater than 40,000 fpm have been obtained. For a nozzle outlet diameter on the order of about 1/16 inch, nozzle velocities may be on the order of from about 2,000 fpm to about 25,000 fpm.

In FIG. 13 is shown a number of the dimensional parameters associated with the respective nozzles 56*a,* 56*b.*

Figure 14:
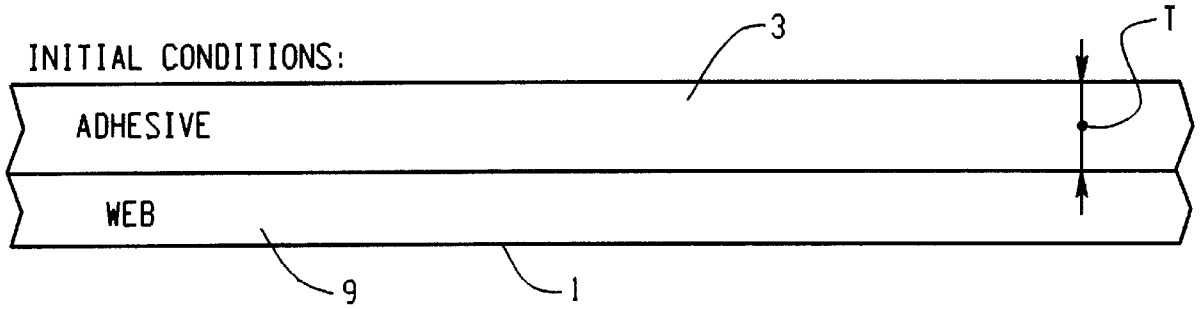
FIG. 14 is a schematic illustration of an emulsion type adhesive coating prior to forming a reduced coat weight portion on a paper web.
Figure 15:
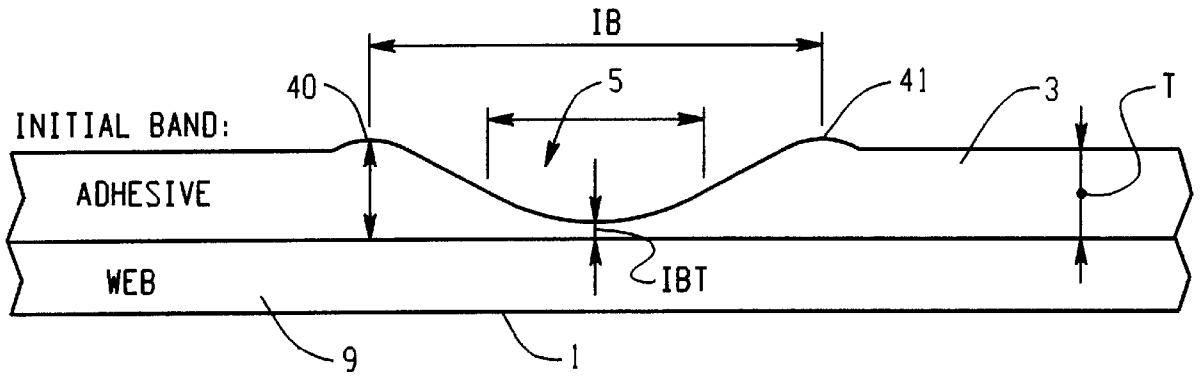
FIG. 15 is a schematic illustration of the adhesive coating of FIG. 14 and of the initial reduced coat weight portion thereof.
Figure 16:
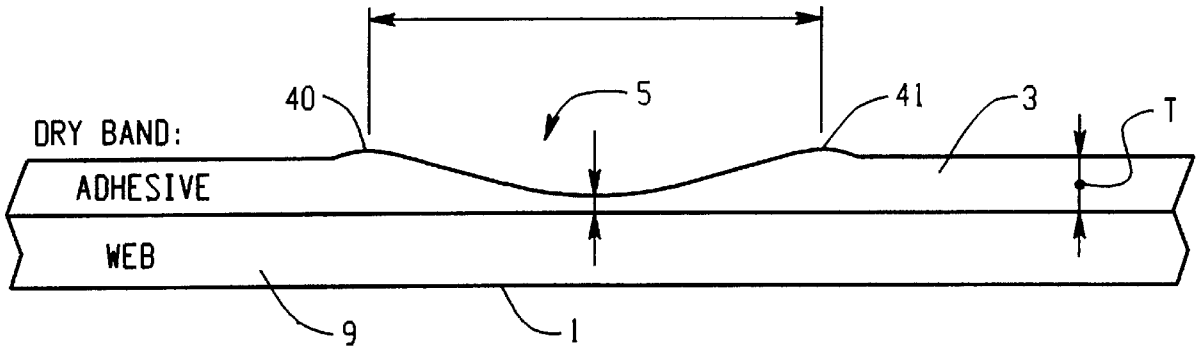
FIG. 16 is a schematic illustration of the adhesive coating on a paper web similar to FIGS. 14 and 15 after the emulsion coating has dried.

Turning now to FIGS. 14, 15 and 16, an example of a cross direction low adhesive coat weight band formation is shown. In FIG. 14 the web 1 is paper and it has an emulsion type of adhesive coating 3 thereon. The initial thickness T of the adhesive coating 3 in FIG. 14, which usually is characterized in terms of coat weight per area, or more simply coat weight, is on the order of from about 5 gsm (grams per square meter) to about 200 gsm, and more preferably on the order of from about 30 gsm to about 60 gsm. It has a dry adhesive coat weight or thickness DT on the order of from about 1 gsm to about 160 gsm, and more preferably from about 15 gsm to about 30 gsm, and a grams per square meter solids content in the emulsion coating of from about 20% to about 80%, and more preferably from about 30% to about 65%.

In FIG. 15 is illustrated the results of the coated web 1 from FIG. 14 being subjected to the cross direction air stream from one of the apertures 56*a,* 56*b* causing the wet coating 3 to flow to form a low adhesive coat weight band or section 5 between a pair of crests 40, 41. The approximate initial distance or width IB of the band 5 between the points on the crests 40, 41 is on the order of from about 1 mm to about 50 mm, and more preferably from about 3 mm to about 25 mm. As for one non-limiting example, the initial (wet) coat weight or thickness IBT of coating material at the low coat weight band between the respective crests is on the order of from about 2 gsm to about 30 gsm, and more preferably on the order of about 10 gsm to about 20 gsm. After drying, curing, etc., these values may change; for example, due to drying and loss of moisture the coat weight would be reduced and spacing or width of the reduced coat weight band may change.

In FIG. 16 is shown an example of such a dried or cured material, which may be subjectively compared with FIG. 15.

Figure 17:
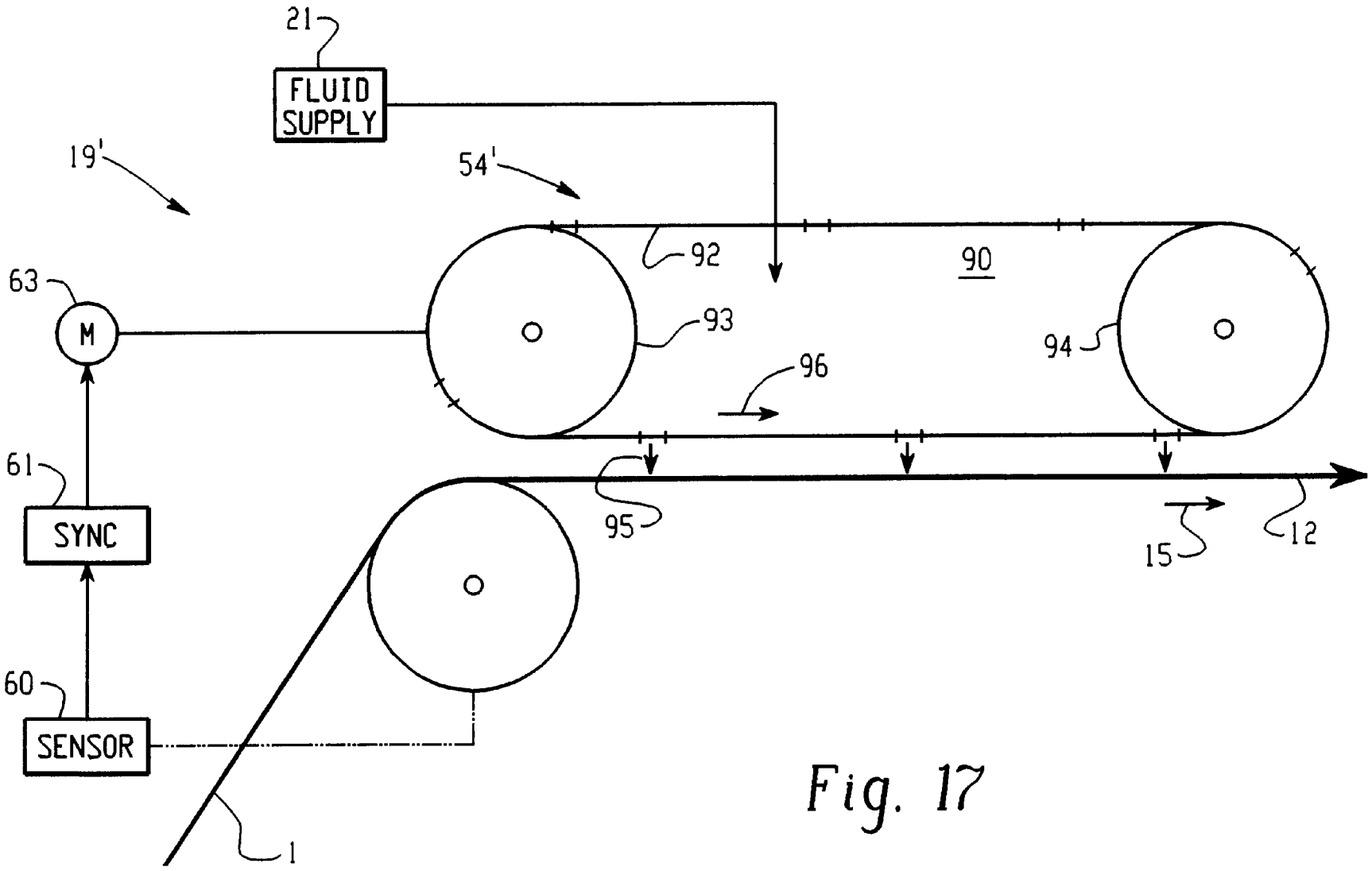
FIG. 17 is a schematic illustration of another embodiment for forming cross direction bands of reduced coat weight on a moving web by directing air flow across the web from a moving nozzle.

Referring briefly to FIG. 17, an alternate embodiment of nozzle system 54' is shown as part of the cross direction air band apparatus 19'. The apparatus 19' and nozzle system 54' have the same function as the system 19 and nozzle system 54 described above. Similar parts are identified by the same reference numerals although in FIG. 17 these parts are designated with a prime (').

The nozzle system 54' includes a chamber 90 that is formed in part by a cyclically moving or rotating plurality of orifices 91. To move the orifices 91, they may be carried by a conveyor belt 92 or the like, which is mounted on a pair of rolls 93 (a drive roll) and 94. Air from the air supply 21 is delivered to the chamber 90 and the air can exit through respective orifices 91 to impinge as respective air streams 95, for example, against the coated web 1.

The web position sensor or encoder 60 senses position of the web 1, for example, as a function of the rotation of the roll 52 and delivers synchronizing signals via the servo controller 61 to a servo drive and motor 63. The servo drive and motor 63 operates the drive roll 93 to move the conveyor belt or support 92 in the direction of the arrow 96, thus moving the orifices 91 synchronously with the coated web 1. Therefore, the location of the air stream 95 provided by a particular orifice 91 remains constant on the web 1 as the web and the orifice move in the same direction at the same speed. The impinging air stream 95 forms the low adhesive coat weight band or area 5 in the cross direction of the web 1.

Figure 18:
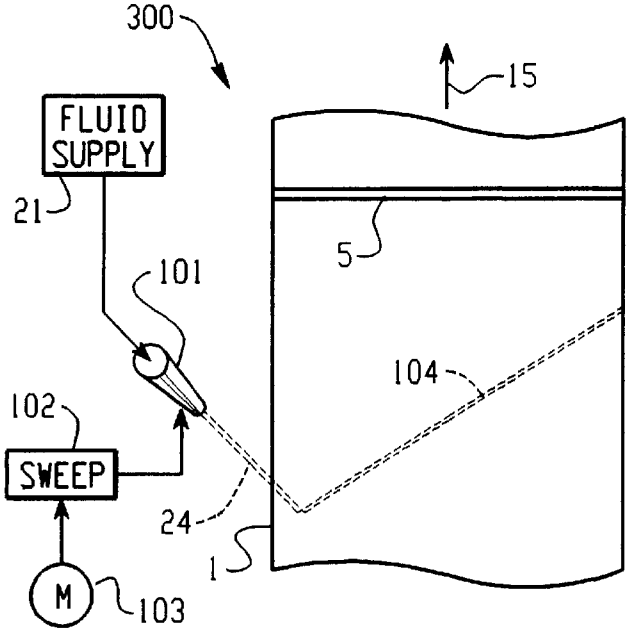
FIG. 18 is a schematic illustration of an alternate embodiment of the invention in which the fluid stream is swept across the moving web to form a cross direction in reduced coat weight area.

Turning to FIG. 18, another embodiment of cross direction low adhesive weight band forming system according to an embodiment of the invention is shown at 100. The apparatus 100 includes an air supply 21 which provides air to a nozzle 101, which may be similar to the nozzles 20*a,* etc., described above. The air stream 24 from the nozzle is swept across the width of the web 1 as the web is moved in the machine direction 15. As is shown, the air stream 24 is swept in a sense in a direction diagonally across the web 1 to take into account the movement of the web in the machine direction 15 as the air stream 24 is swept across so that the resulting band of low adhesive coat weight band 5 formed in the web coating is substantially transverse to the machine direction 15. A sweep mounting system 102 and a motor 103 coupled thereto are operative to sweep the nozzle 101 or to deflect the air stream 24 across the web 1 in the direction of the dotted line 104 in FIG. 18 to obtain such effective low adhesive coat weight cross direction band 5.

Figure 19:
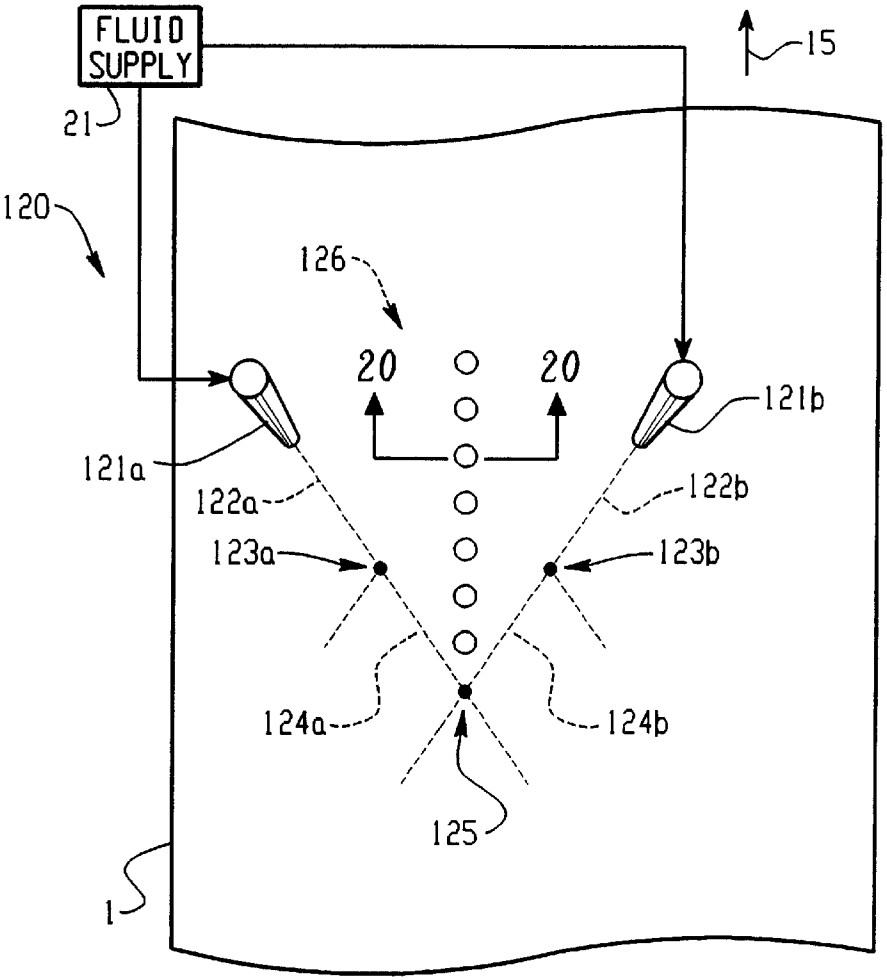
FIG. 19 is another embodiment of the invention wherein plural fluid streams are directed at a coated web to move coating material away from the areas of impingement causing the coating material to undergo constructive interference to effect increased coat weight at such interference area.
Figure 20:
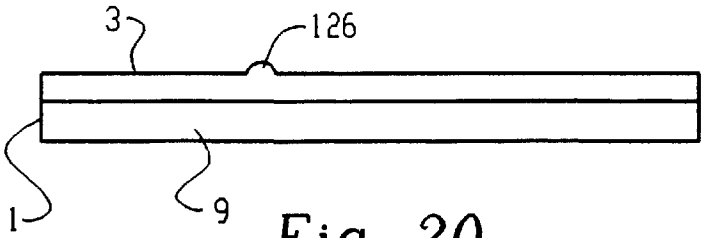
FIG. 20 is a fragmentary section view of the web of FIG. 19 looking generally in the direction of the arrows 20—20 of FIG. 19.

In FIGS. 19 and 20 another embodiment of using air flow to form nonuniform adhesive coat weight areas on a web is illustrated at 120. The apparatus 120 includes a plurality of nozzles 121*a,* 121*b,* which may be similar to the nozzles 20*a.* Each of the nozzles 121*a,* 121*b* is supplied with air from an air supply 21. The nozzles direct respective air streams 122*a,* 122*b* at respective locations 123*a,* 123*b* to cause coating material on the web 1 to be moved somewhat like the forming of a wake as a boat travels through water. The wake is a wave, the edges of which are shown, respectively, at 124*a,* 124*b,* and those wave edges may intersect each other, for example, at 125. The intersection point may be in effect a constructive interference result causing an increase in the thickness or adhesive coat weight of the coating material there. A series of dots 126 represent the line of such increased adhesive coat weight along the length of the web having been formed by such intersecting wave portions.

In FIG. 20 a cross sectional view of such line is seen looking at the leading edge of the web 1 in the direction of the arrows 20—20 of FIG. 19.

Using the principles of the invention as described with respect to the apparatus 120, it will be appreciated that the web 1 may have a relatively low adhesive coat weight coating across the surface thereof and one or more increased adhesive coat weight strips, lines or areas may be formed in the web where areas of increased adhesion will be provided.

Sometimes the process of drying or curing the coating on the web may cause a change in length, such as shrinkage, and, therefore, it is desirable to monitor and to control the locations of the cross direction bands 5. Drying may be carried out by heat, evaporation, steam application, etc. After the coated web passes through the dryer and the face material 10 is laminated thereto to produce the product 8.

Figure 21:
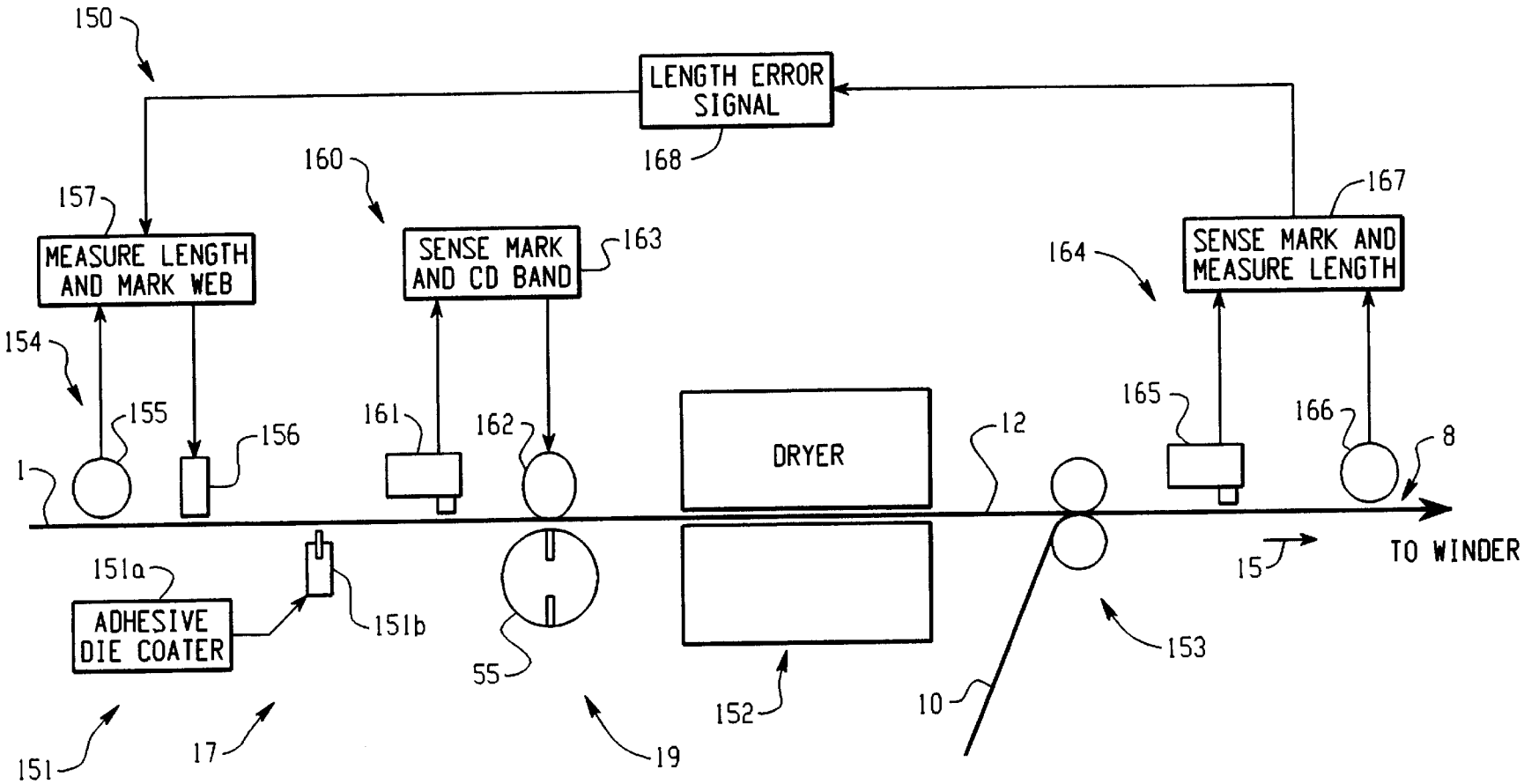
FIGS. 21 and 22 are schematic illustrations of monitor and control systems used in embodiments of the invention.

Referring now to FIG. 21, a monitor and control system 150 for use in the apparatus 17 of the invention is illustrated schematically. The monitor and control system 150 monitors the web 1 and finished product 8 during manufacturing to control accurate placing of the low adhesive coat weight cross direction bands 5. The measuring and control system 150 is placed in the apparatus 17 relative to the adhesive dye coater 151, cross direction band forming apparatus 19, dryer 152, and laminator 153. In the apparatus 17 and monitor and control system 150, the web 1 (sometimes referred to as the liner 9), is coated with adhesive material by the adhesive dye coater 151, which includes a supply 151*a* of adhesive material and a die 151*b* from which the adhesive material is applied to the web 1. The cross band forming apparatus 19 forms low coat weight areas, regions or bands across the width of the web, as was described above. Various techniques may be used to form the cross direction band, several examples of which are described above. The coated web passes through a dryer 152 which dries, cures or otherwise assists in setting up of the adhesive material, one example being removing liquid, such as water or solvent from an emulsion or solution, and another example being heating to cause curing, cross linking or the like of the adhesive material. The laminator 153 applies the face material 10, for example, sheet material, to the coated web or liner to form a finished product 8. The finished product leaves the monitor and control system 150 and apparatus 17 in the machine direction 15 and may be delivered to a winding apparatus where the product is stored on rolls, to a cutting apparatus where the product is cut into respective sheets, etc.

The monitoring control system 150 includes a web length measuring and marking apparatus 155, including a detector 155, such as a roller, tachometer, or other device to measure the movement or length of the web 1 as it travels in the direction 15, and a marking device 156 that applies a visible or invisible mark to the liner at specified locations which are spaced apart periodically according to the length detected by the detector 155. A controller 157, such as an electric circuit, a mechanical device, computer, a combination thereof, etc., receives an input from the detector 155 representing length information and controls the marking device 156 to mark the web at desired locations. The length measuring and marking apparatus 157 may be relatively upstream or downstream of the adhesive dye coating of the adhesive dye coater 151 relative to the travel direction of the web 1. The monitor and control system 150 also includes an apparatus to sense the marks produced by the marker 156 and to coordinate the placing of the cross direction bands 5 of low coat weight on the web 1 by the apparatus 19.

More specifically, the apparatus 160 includes a mark sensor 161, such as an optical device which senses the mark produced by the mark 156, and a controller 162, such as a roll, servo motor, or the like, which is mechanically coupled and/or otherwise coordinated with rotating orifices 56*a,* 56*b* to place the cross direction bands at the desired locations on the web 1 relative to the location of a mark detected by the detector 161. The apparatus 160 may include a circuit, computer, or other device, such as a servo control device 163, which in response to the detecting of a mark by the detector 161 controls the servo motor 162 and apparatus 19 to place the cross direction bands at desired locations.

A mark sensing and length measuring apparatus 164 is downstream of the dryer and also may be downstream of the laminator. It also may be upstream of the laminator if desired. The apparatus 164 includes a mark sensing apparatus 165, such as an optical detector, which detects the respective marks; a distance or length sensor 166 which measures the length of the web using a length sensor, such as a roller and tachometer or other length measuring device; and a circuit, computer or other device 167 which responds to the data from the sensors 165, 166 to indicate the distance between respective marks. (The marking device and mark sensing apparatus (and distance or length measuring apparatus) mentioned here and elsewhere in this specification are exemplary, and it will be appreciated that other devices may be used consistent with the invention.) That distance information is delivered to a length error signal circuit 168, which produces an output indicating whether the distance between respective marks is acceptable or whether the distance should be changed. If the distance is incorrect, e.g., due to web shrinkage or expansion in the dryer, the error signal from the circuit 168 causes the measure length and mark web apparatus 154 to alter the distance between marks and, thus, the distance between respective cross direction bands produced by the apparatus 19.

Summarizing operation of the apparatus 150, the web length is measured and the web is marked at specified length intervals by the apparatus 154. The apparatus 160 controls or registers the cross direction band forming apparatus 19 to form cross direction bands in the coating of the web at locations determined by the placement of the respective marks. After lamination, the marks are sensed and the length is measured to provide a length error signal to correct the mark length at its generation point by the marker 156.

The monitor and control system 150 is especially useful to assure proper placing of the cross direction bands 5 as conditions of manufacturing change and/or as materials used in manufacturing change. Examples of such manufacturing changes include changing humidity, changing temperature, changing speeds, etc. Examples of materials changes include different characteristics of paper and plastic webs; different characteristics of emulsion and hot melt adhesive coatings, different widths of web, different liner and/or facing materials, different characteristics of the adhesive material or other coating material, etc.

Figure 22:
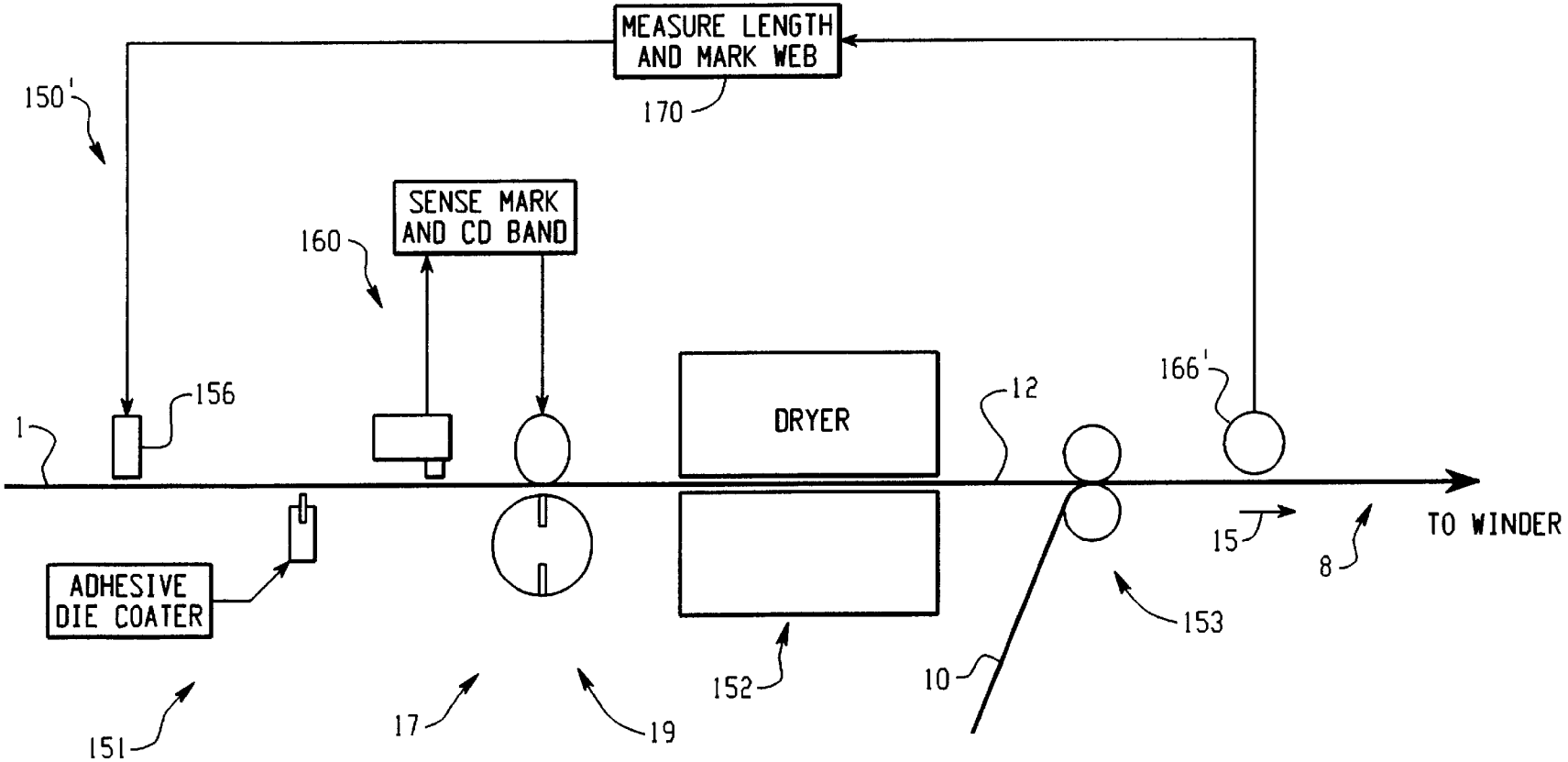

In FIG. 22 is illustrated schematically a modified monitor and control system 150' used in connection with an apparatus 17. The system 150' is similar to the system 150 except that the system 150' has eliminated some components and is useful especially in steady state conditions of web 1 and product 8 manufacturing. For example, the system 150' is particularly useful in the circumstance that the apparatus 17 has been set up for use with a particular set of materials and particular set of manufacturing conditions and parameters which ordinarily would not vary. Although the system 150' may account for growth/shrinkage in length, as does the system 150, it may not be as versatile or effective in handling speed changes or other process upsets.

In using the monitor and control system 150' of FIG. 22, the marker 156 marks the web to identify a reference location with respect to which cross direction banding is to occur. The adhesive die coater 151 applies adhesive to the web, and the apparatus 160 detects the marks and controls the location at which the cross direction bands are formed. The coated web is dried in the dryer 152 and the face material is laminated to the coated web 1 at the laminator 153. A length detector 166' located downstream of the laminator 153 measures web length. The length information is coupled to a circuit, computer or other device 170, which in turn couples a signal to the marker 156 to mark the web and selected spaced-apart locations. Operation of the cross direction banding apparatus 19 then is similar to that described above with respect to the apparatus 17 including the monitor and control system 150 of FIG. 21.

It will be appreciated that the techniques, structures and methods disclosed may be used to affect and/or to organize a coating on a surface. For example, bands or areas of reduced coat weight or even of zero coat weight (no coating) can be formed by appropriate fluid impingement onto the coating.

Also, bands on areas of increased coat weight can be formed, for example, by constructive wave interference type process.

Virtually any pattern can be formed in or of the coating using principles of the invention. A desired pattern of reduced coat weight bands can be formed by a corresponding pattern of sweeping one or more air stream(s) across the coating relative to a fixed or moving web. Another pattern of reduced coat weight bands or areas can be formed by changing the speed of rotation of the air blade system 19 relative to the web and/or changing the size or shape of the air from the air blade, the nozzles 56*a,* 56*b,* aperture 59 in the shield 58; or by changing the size of ports 91 or speed of belt 92 relative to the web; or by other equivalent changes.

Thus, it will be appreciated that the techniques of the invention advantageously can pattern a coating on a surface in a multitude of ways. A corollary advantage is to reduce the amount of coating necessary for a purpose. For example the amount of adhesive on a label may be reduced so only the amount needed for specified adhesion function would be used, which would save adhesive coating material (or other coating material), e.g., reduce the required amount of coating material to achieve a desired function.

STATEMENT OF INDUSTRIAL APPLICATION

It will be appreciated that the present invention may be used in connection with the manufacturing of various coated materials.

The embodiments of the invention claimed are, as follows:

1. A method for forming a band of reduced coat weight of a coating on a coated web, comprising directing toward the web a stream of fluid, which extends over a relatively narrow width of the web compared to the width of the web, to impinge on the web to reduce the coat weight over a relatively narrow width band.

2. The method of claim 1, said directing comprising directing the fluid through a nozzle.

3. The method of claim 2, wherein the diameter of the nozzle is of a size of from about 1/64 inch to about 1 ½ inch.

4. The method of claim 3, wherein the diameter of the nozzle is of a size of from about 1/32 inch to about 3/16 inch.

5. The method of claim 2, comprising moving the web in a direction and using said nozzle to cause impingement of fluid against the web at an angle relative to a normal to the surface of the web of from about plus 60 degrees to about minus 60 degrees.

6. The method of maim 5, comprising directing fluid from the nozzle to cause impingement of fluid against the web at an angle relative to a normal to the surface of the web of from about plus 25 degrees to about minus 25 degrees.

7. The method of claim 6, comprising directing fluid from the nozzle to cause impingement of fluid against the web at an angle approximately normal to the surface of the web.

8. The method of claim 3 wherein the nozzle is slot-like.

9. The method of claim 8, wherein one dimension of the nozzle is on the order of from about 1/64 inch to about 1 ½ inch.

10. The method of claim 9, wherein said one dimension of the nozzle is on the order of from about 1/32 inch to about 3/16 inch.

11. The method of claim 2, comprising supplying such fluid such that the static pressure of fluid to the nozzle is from about 0.5 to about 110 psig.

12. The method of claim 11, comprising supplying fluid to the nozzle at a static pressure of fluid from about 2.0 to about 10.0 psig.

13. The method of claim 1, further comprising controlling delivery of fluid from said nozzle to the web.

14. The method of claim 1, further comprising starting and stopping delivery of fluid from said nozzle to the web.

15. The method of claim 1, comprising directing plural streams to form plural respective bands.

16. The method of claim 1, wherein the web is moving in a direction, and further comprising directing a stream of fluid transversely relative to said direction across a substantial width of the web relative to said first-mentioned stream to impinge against the web at selected locations along the web to reduce the coat weight over a relatively narrow band that extends transversely across the web for said substantial width.

17. The method of claim 16, further comprising controlling registration of the reduced coat weight bands with respective locations.

18. The method of claim 1, wherein said directing comprises directing through a nozzle having an outlet and the distance between the outlet and the web is from about 1/16 inch to about 1 inch.

19. The method of claim 18, wherein the distance between the outlet and the web is from about ⅛ inch to about ½ inch.

20. The method of claim 1, comprising directing the fluid to impinge on the web to push coating material away from the area of impingement, and selecting the temperature of the fluid to cause an increased viscosity of the coating material adjacent the band.

21. The method of claim 1, comprising directing the fluid to impinge on the web to push coating material away from the area of impingement, and causing a skin to form on the coating material adjacent the band.

22. The method of claim 1, wherein the web is from about 1 to about 200 inches wide.

23. The method of claim 22, wherein the web is from about 50 to about 90 inches wide.

24. The method of claim 22, wherein the web is from about 15 to about 35 inches wide.

25. The method of claim 1, further comprising moving the fluid stream across at least part of the width of the web while the web is moving in a direction generally transverse to the width of the web.

26. The method of claim 1, further comprising moving the web at from about 100 feet per minute to about 5,000 feet per minute.

27. The method of claim 26, wherein the bands are on the order of from about ⅛ inch to about 3 inch wide.

28. The method of claim 1, wherein the bands are spaced apart from about ¼ inch to about 18 inches.

29. The method of claim 28, wherein the bands are spaced apart from about 8 to about 18 inches.

30. A method for forming a low adhesive coat weight band on a coated web moving in a direction, comprising selectively directing against respective areas of the web a fluid stream across at least a substantial portion of the width of the web generally in a cross direction relative to said direction to thin the coating on the area of impingement.

31. The method of claim 30, said directing causing thinning of the coating to zero thickness.

32. The method of claim 30, said directing causing thinning of the coating to a coat weight thickness on the order of from about 0.5 to about 75 gsm.

33. The method of claim 30, said directing causing thinning of the coating to a coat weight thickness on the order of from about 1.2 to about 35 gsm.

34. The method of claim 30, wherein the coating comprises an emulsion.

35. The method of claim 30, wherein the coating comprises a hot melt material.

36. The method of claim 30, wherein the coating comprises a solvent coating.

37. The method of claim 30, wherein the coating comprises a multiple layer coating.

38. The method of claim 30, wherein the coating has a plurality of components.

39. The method of claim 30, said directing comprising direct an air flow.

40. The method of claim 30, said directing comprising periodically directing the fluid stream against the web in synchronization with web travel.

41. The method of claim 30, further comprising directing a stream of fluid toward the web and extending over a relatively narrow width of the web compared to the width of the web to impinge on the web to reduce the coat weight over a relatively narrow width band extending in said direction.

42. The method of claim 30, said directing comprising directing fluid from a rotating orifice the rotational speed of which is coordinated with movement of the web.

43. The method of claim 42, said directing comprising directing fluid through plural rotating orifices, and coordinating the orifices such that respective orifices direct fluid against respective areas of the web.

44. The method of claims 30, said directing comprising periodically directing fluid through an opening in a shield positioned relative to the web.

45. The method of claim 30, said directing comprising periodically opening and closing a shutter selectively to control flow of fluid to the web.

46. The method of claim 30, comprising providing fluid to a movable orifice, moving the orifice in coordination with the web, and said directing comprising directing fluid through said movable orifice against said web as said orifice and web are in coordinated alignment and motion.

47. The method of claim 30, wherein the coating material is adhesive material and the adhesive coat weight thickness at the low coat weight band is on the order of from about 0.5 to about 75 gsm.

48. The method of claim 47, wherein the adhesive coat weight at areas outside the band is on the order of from about 0.6 to about 80 gsm.

49. The method of claim 30, wherein the web is from about 1 to about 200 inches wide.

50. The method of claim 49, wherein the web is from about 50 to about 90 inches wide.

51. The method of claim 49, wherein the web is from about 15 to about 35 inches wide.

52. The method of claim 30, further comprising controlling delivery of fluid from said nozzle to the web.

53. The method of claim 30, further comprising starting and stopping delivery of fluid from said nozzle to the web.

54. The method of claim 30, further comprising moving the web at from about 100 feet per minute to about 5,000 feet per minute.

55. The method of claim 54, wherein the bands are on the order of from about ⅛ inch to about 3 inch wide.

56. The method of claim 54, wherein the bands are spaced apart from about ¼ to about 18 inches.

57. The method of claim 56, wherein the bands are spaced apart from about 8 to about 18 inches.

* * * * *